US011529726B2

(12) United States Patent
Bantle et al.

(10) Patent No.: US 11,529,726 B2
(45) Date of Patent: Dec. 20, 2022

(54) HAND-HELD POWER TOOL COMPRISING A COMMUNICATION INTERFACE

(71) Applicant: Robert Bosch GmbH, Stuttgart (DE)

(72) Inventors: Florian Bantle, Westerheim (DE); Juergen Gairing, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 513 days.

(21) Appl. No.: 16/061,364

(22) PCT Filed: Dec. 8, 2016

(86) PCT No.: PCT/EP2016/080207
§ 371 (c)(1),
(2) Date: Jun. 12, 2018

(87) PCT Pub. No.: WO2017/102532
PCT Pub. Date: Jun. 22, 2017

(65) Prior Publication Data

US 2018/0354114 A1 Dec. 13, 2018

(30) Foreign Application Priority Data

Dec. 18, 2015 (DE) ..... 10 2015 226 084.4

(51) Int. Cl.
*B25D 16/00* (2006.01)
*B25F 5/00* (2006.01)
*B25B 21/02* (2006.01)

(52) U.S. Cl.
CPC ..... *B25D 16/006* (2013.01); *B25B 21/02* (2013.01); *B25B 21/023* (2013.01); (Continued)

(58) Field of Classification Search
CPC ..... B25F 5/001; B25D 16/003; B25D 16/006; B25D 2216/0023; B25D 2216/003; (Continued)

(56) References Cited

U.S. PATENT DOCUMENTS 5,090,485 A * 2/1992 Pomonik ..... E21B 7/24 173/1
6,181,032 B1 * 1/2001 Marshall ..... H01M 2/1022 307/150

(Continued)

FOREIGN PATENT DOCUMENTS

CN 101200061 A 6/2008
CN 102615633 A 8/2012

(Continued)

OTHER PUBLICATIONS

International Search Report corresponding to PCT Application No. PCT/EP2016/080207, dated Apr. 3, 2017 German and English language document) (7 pages).

(Continued)

*Primary Examiner* — Robert F Long
(74) *Attorney, Agent, or Firm* — Maginot, Moore & Beck LLP

(57) ABSTRACT

A hand-held power tool includes a drive unit that has at least one gear-shift transmission which can shift at least between two different gear steps; a striking mechanism that can be activated for performing a striking mode is associated with the drive unit; a shifting unit is provided for shifting the gear-shift transmission between the at least two different gear steps and/or for activating/deactivating the striking mechanism, and a communication interface is provided for communicating with a user-actuated user guiding unit and is configured to receive shifting instructions from the user guiding unit in order for the transmission to shift in an application-specific manner between the two different gear steps and/or for the striking mechanism to be activated/deactivated.

15 Claims, 20 Drawing Sheets

(52) U.S. Cl.
CPC ..... *B25D 16/003* (2013.01); *B25F 5/001* (2013.01); *B25D 2211/061* (2013.01); *B25D 2216/0023* (2013.01); *B25D 2216/0038* (2013.01); *B25D 2250/165* (2013.01); *B25D 2250/201* (2013.01)

(58) Field of Classification Search
CPC .... B25D 2216/0038; B25D 2216/0015; B25D 2250/165; B25D 2250/201; B25D 11/064; B25D 11/08; B21B 4/006; B23Q 5/48; B25B 13/00; B25B 13/467; B25B 15/00; B25B 17/00
USPC ..... 173/216, 221, 161, 170
See application file for complete search history.

(56) References Cited

U.S. PATENT DOCUMENTS

| | | | | |
|---|---|---|---|---|
| 6,983,809 | B2 * | 1/2006 | Leitenberger | B25B 21/00 173/176 |
| 9,088,239 | B2 | 7/2015 | Kaizo et al. | |
| 9,256,988 | B2 | 2/2016 | Wenger et al. | |
| 9,833,890 | B2 | 12/2017 | Ito et al. | |
| 10,131,042 | B2 | 11/2018 | Mergener et al. | |
| 10,131,043 | B2 | 11/2018 | Mergener et al. | |
| 10,213,908 | B2 | 2/2019 | Mergener et al. | |
| 10,510,199 | B2 * | 12/2019 | Hoossainy | E05B 17/22 |
| 10,569,398 | B2 | 2/2020 | Mergener et al. | |
| 2007/0007024 | A1 * | 1/2007 | Tokairin | B25D 11/106 173/48 |
| 2007/0034394 | A1 * | 2/2007 | Gass | B25H 1/0092 173/2 |
| 2007/0084613 | A1 * | 4/2007 | Zhang | B25F 5/00 173/1 |
| 2008/0196912 | A1 | 8/2008 | Gass et al. | |
| 2009/0195204 | A1 * | 8/2009 | Gumpert | B25D 11/00 318/460 |
| 2012/0037386 | A1 * | 2/2012 | Cook | B25F 5/021 173/30 |
| 2012/0214640 | A1 | 8/2012 | Saur | |
| 2012/0223121 | A1 * | 9/2012 | Viola | A61B 17/072 227/175.1 |
| 2012/0228358 | A1 * | 9/2012 | Zemlok | A61B 90/90 227/176.1 |
| 2012/0234566 | A1 * | 9/2012 | Mashiko | B25B 21/02 173/93.5 |
| 2012/0292070 | A1 | 11/2012 | Ito et al. | |
| 2013/0021783 | A1 * | 1/2013 | Vanko | B25B 23/18 362/119 |
| 2013/0075121 | A1 * | 3/2013 | Nakamura | B25B 21/02 173/94 |
| 2013/0133907 | A1 * | 5/2013 | Chen | B25F 5/00 173/20 |
| 2013/0165292 | A1 * | 6/2013 | Brugger | F16H 3/44 475/294 |
| 2014/0015465 | A1 | 1/2014 | Kaizo et al. | |
| 2014/0069672 | A1 | 3/2014 | Mashiko et al. | |
| 2014/0070924 | A1 | 3/2014 | Wenger et al. | |
| 2014/0107853 | A1 | 4/2014 | Ashinghurst et al. | |
| 2014/0240125 | A1 * | 8/2014 | Burch | G08B 21/0213 340/539.13 |
| 2014/0246893 | A1 * | 9/2014 | Tesar | B60K 7/0007 301/6.5 |
| 2014/0338946 | A1 * | 11/2014 | Herr | B25D 16/006 173/104 |
| 2014/0379136 | A1 * | 12/2014 | Schlegel | B25B 21/00 700/275 |
| 2015/0080912 | A1 * | 3/2015 | Sapre | A61B 17/07207 606/139 |
| 2015/0303848 | A1 * | 10/2015 | Beck | H02P 7/29 318/503 |
| 2015/0367497 | A1 * | 12/2015 | Ito | B25F 5/02 173/217 |
| 2016/0121473 | A1 * | 5/2016 | Brennenstuhl | F16H 3/48 173/216 |
| 2016/0226278 | A1 * | 8/2016 | Wenger | H02J 7/0044 |
| 2016/0311094 | A1 * | 10/2016 | Mergener | B25B 23/1475 |
| 2016/0354888 | A1 * | 12/2016 | Huber | F16D 48/06 |
| 2016/0375570 | A1 | 12/2016 | Boeck et al. | |
| 2017/0008159 | A1 | 1/2017 | Boeck et al. | |
| 2019/0217460 | A1 * | 7/2019 | Mahalingappa | B25F 5/001 |

FOREIGN PATENT DOCUMENTS

| | | | | |
|---|---|---|---|---|
| DE | 10 2011 004 495 | A1 | 8/2012 | |
| DE | 10 2011 007 648 | A1 | 10/2012 | |
| DE | 102011007648 | A1 * | 10/2012 | B25B 21/008 |
| DE | 10 2012 212 404 | A1 | 1/2014 | |
| DE | 10 2012 212 417 | A1 | 2/2014 | |
| DE | 10 2012 216 602 | A1 | 3/2014 | |
| EP | 1 932 625 | A2 | 6/2008 | |
| EP | 2 168 724 | A1 | 3/2010 | |
| EP | 2 848 371 | A1 | 3/2015 | |
| GB | 2404891 | A * | 2/2005 | B25D 16/006 |
| WO | 2013/187411 | A1 | 12/2013 | |
| WO | 2015/061370 | A1 | 4/2015 | |
| WO | 2015-110245 | A1 | 7/2015 | |

OTHER PUBLICATIONS

International Search Report corresponding to PCT Application No. PCT/EP2016/080132, dated Mar. 1, 2017 (German and English language document) (7 pages).

* cited by examiner

HAND-HELD POWER TOOL COMPRISING A COMMUNICATION INTERFACE

This application is a 35 U.S.C. § 371 National Stage Application of PCT/EP2016/080207, filed on Dec. 8, 2016, which claims the benefit of priority to Serial No. DE 10 2015 226 084.4, filed on Dec. 18, 2015 in Germany, the disclosures of which are incorporated herein by reference in their entirety.

BACKGROUND

The disclosure relates to a portable power tool having a drive unit which has at least one shiftable gearbox which is shiftable at least between two different gear ratios, the drive unit is assigned a percussion mechanism which is able to be activated in order to carry out a percussive operation.

Portable power tools which have a drive unit with a drive motor, wherein the drive unit is assigned a percussion mechanism and/or a shiftable gearbox, are known from the prior art. In order to activate/deactivate the percussion mechanism and/or shift the drive unit between two or more different gear ratios, the drive unit is in this case assigned in each case a manually actuable shifting element.

Furthermore, EP 2 848 371 A1 discloses a portable power tool having a gearshift unit which is provided with an actuable shifting ring and an actuating unit with a servomotor. In this case, the servomotor is configured, upon activation, to actuate the actuable shifting ring in order to shift between different gear ratios. This portable power tool does not have a percussion mechanism, however.

SUMMARY

The disclosure provides a novel portable power tool having a drive unit which has at least one shiftable gearbox which is shiftable at least between two different gear ratios, wherein the drive unit is assigned a percussion mechanism which is able to be activated in order to carry out a percussive operation. A shifting unit for shifting the shiftable gearbox between at least two different gear ratios and/or for activating/deactivating the percussion mechanism is provided, wherein a communication interface is provided, which is provided for communication with a user guidance unit that is actuable by a user, and is configured to receive, from the user guidance unit, shifting instructions for the application-specific shifting of the gearbox between the two different gear ratios and/or for activating/deactivating the percussion mechanism.

Therefore, the disclosure allows the provision of a portable power tool in which simpler shifting of the shiftable gearbox and/or simpler activation/deactivation of the percussion mechanism can be enabled. In this way, an application-specific gear shifting and/or activation/deactivation of the percussion mechanism can be enabled in a simple and uncomplicated manner via the user guidance unit, or the shifting instructions thereof, wherein even an inexperienced user can effect appropriate shifting for a specific application.

Preferably, the user guidance unit is integrated at least partially into the portable power tool and/or is configured at least partially as an external, separate component. In this way, a suitable user guidance unit can be provided in a simple manner.

The user guidance unit preferably has a mobile computer, in particular a mobile computer configured in the manner of a smartphone or tablet computer. Alternatively, it is also possible for other "smart devices", as they are known, for example a watch, spectacles etc., to be used as mobile computer. Furthermore, gesture control can also be used. In this way, a user guidance unit for gear setting/impact setting and/or for inputting and outputting setting information can be provided in a simple and uncomplicated manner.

According to one embodiment, for communication with the communication interface, the user guidance unit has an interactive program, in particular a smartphone app. In this way, safe and reliable communication of the user guidance unit with the communication interface can be allowed.

Preferably, the user guidance unit has at least one control element for initiating a shifting operation for shifting the gearbox between the two different gear ratios and/or for activating/deactivating the percussion mechanism, wherein the communication interface is configured to send a control signal to the at least one control element in order to allow the generation of a request for initiation of a shifting operation for shifting the gearbox between the two different gear ratios by the at least one control element and/or to send a control signal to the at least one control element in order to allow the generation of a request for initiation of activation/deactivation of the percussion mechanism by the at least one control element. In this way, a shifting operation can be initiated in a simple manner.

Preferably, the at least one control element is provided with an illumination means and the control signal is configured to activate the illumination means in order to visualize the request for initiation of a shifting operation for shifting the gearbox between the two different gear ratios and/or for initiating the activation/deactivation of the percussion mechanism. In this way, a user of the portable power tool can identify a control element to be operated in a simple and uncomplicated manner.

The at least one control element is configured preferably as a switch or button. In this way, an uncomplicated and cost-effective control element can be provided.

According to one embodiment, the at least one control element has a display and the control signal is configured to generate on the display an indication for visualizing the request for initiating a shifting operation for shifting the gearbox between the two different gear ratios and/or for initiating the activation/deactivation of the percussion mechanism. In this way, any erroneous setting in a shifting operation can be at least largely avoided.

Preferably, the display is configured in the manner of a touchscreen. In this way, a suitable display can be provided in a simple manner.

Preferably, the at least one control element is actuable to initiate a shifting operation for shifting the gearbox between the two different gear ratios and/or to initiate the activation/deactivation of the percussion mechanism, and has a sensor which is configured to transmit an actuation signal to the communication interface upon actuation of the at least one control element. In this way, actuation of the control element can be confirmed in a simple and uncomplicated manner, and for example a further setting step can be indicated on the display.

The shifting unit has preferably at least one servomotor, which is configured, upon activation, to shift the gearbox between the two different gear ratios and/or, upon activation, to activate/deactivate the percussion mechanism. In this way, automated gear shifting and/or activation/deactivation of the percussion mechanism can be allowed.

According to one embodiment, the at least one servomotor is able to be activated by actuation of the at least one control element. In this way, gear shifting and/or activation/ deactivation of the percussion mechanism can be controlled or triggered in a safe and uncomplicated manner by a user.

The communication interface is preferably configured to transmit a control signal to the at least one servomotor in order to activate the at least one servomotor. In this way, an activation signal of the at least one control element can be transmitted easily and safely to the servomotor.

Preferably, the communication interface is configured to transmit a control signal to actuators of the portable power tool, wherein at least one actuator is configured, upon activation by the communication interface, to shift the gearbox between the two different gear ratios and/or to activate the percussion mechanism. In this way, the automated gear shifting and/or activation/deactivation of the percussion mechanism can be allowed in a simple manner.

Preferably, the communication interface is configured in the manner of a wireless transmission module, in particular as a radio module for wireless communication by means of the Bluetooth standard. In this way, a safe and reliable communication interface can be provided.

BRIEF DESCRIPTION OF THE DRAWINGS

The disclosure is explained in more detail in the following description with reference to exemplary embodiments illustrated in the drawings, in which.

DETAILED DESCRIPTION

Figure 1:
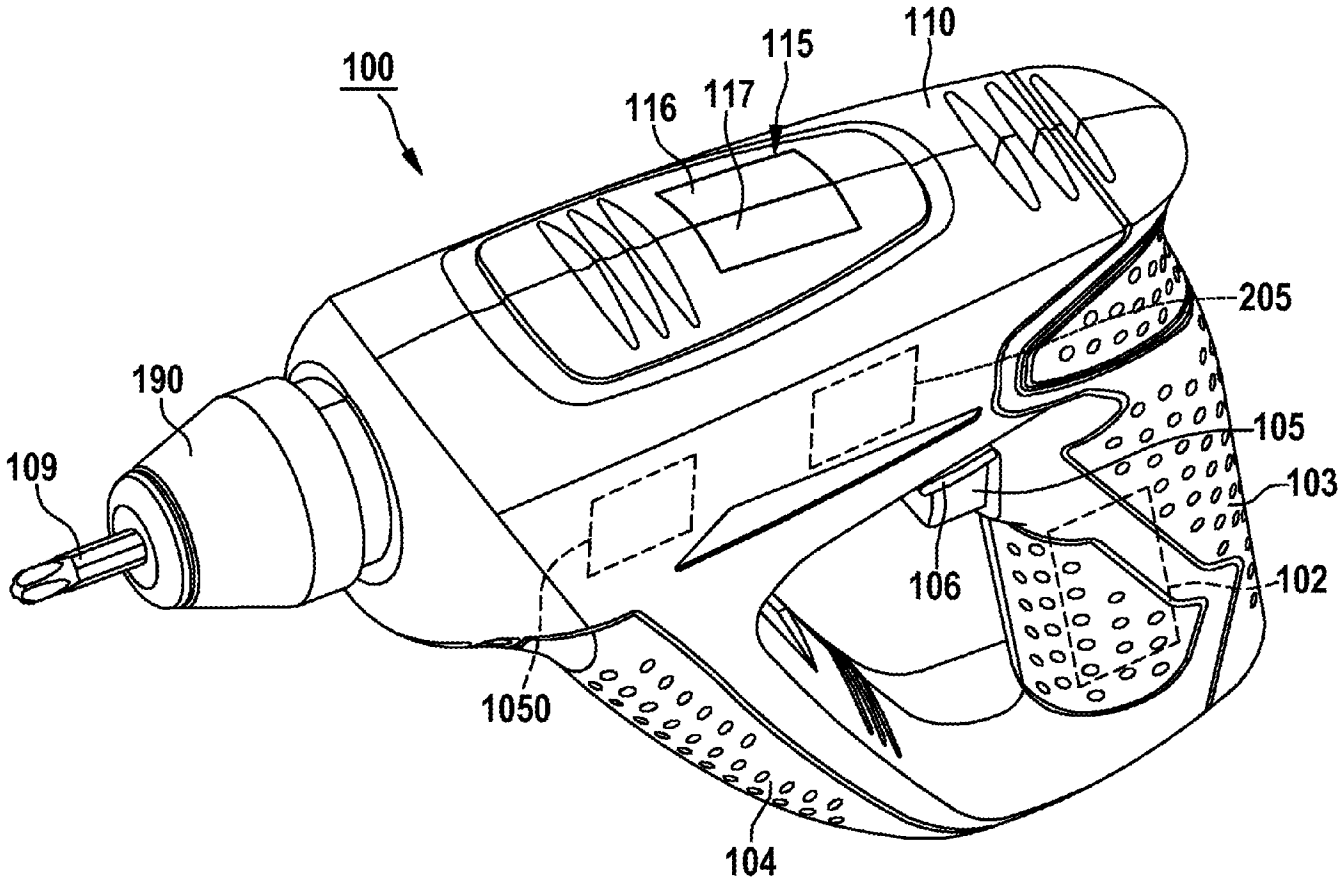
FIG. 1 shows a perspective view of a portable power tool having a shifting unit and a communication interface.

FIG. 1 shows an exemplary portable power tool 100 having a housing 110 in which at least one drive motor (210 in FIG. 2) for driving a preferably interchangeable application tool 109 that is arrangeable in a tool receptacle 190 in at least one non-percussive operating mode is arranged. The tool receptacle 190 is preferably configured to receive application tools with an external coupling, for example a screwdriver bit, and/or to receive application tools with an internal coupling, for example a socket wrench. In the illustration, the tool receptacle 190 is connected to an application tool 109 with an external coupling, wherein the application tool 109 in FIG. 1 is configured for example as a screwdriver bit. Such a screwdriver bit is well known from the prior art, and so, for the sake of conciseness of the description, a detailed description will be dispensed with here.

Preferably, the housing 110 has at least one handle. In the illustration, the housing 110 has a first handle 103 and a second handle 104. In this case, the two handles 103, 104 each have a gripping region which is configured to be held by a hand of a user during operation. The first handle 103 is arranged for example at an end of the portable power tool 100 that is remote from the tool receptacle 190, and the second handle 104 is arranged at an end of the portable power tool 100 that is close to the tool receptacle 190. In the illustration, a hand switch 105 is arranged on the first handle 103.

The drive motor (210 in FIG. 2) is actuable, i.e. able to be switched on and off, for example via the hand switch 105, and preferably electronically controllable such that both reverse operation and demands with regard to a desired rotational speed are able to be realized. Preferably, the hand switch 105 is assigned an on/off switch, wherein the hand switch 105 is configured preferably as a trigger, but can also be configured as a push button. Furthermore, in the region of the hand switch 105, preferably a direction of rotation switch 106 is arranged, via which optionally a direction of rotation of the drive motor (210 in FIG. 2) or of an output shaft assigned to the drive motor is settable. Furthermore, the portable power tool 100 is preferably connectable to a rechargeable battery pack 102 in order to be supplied with power independently of the mains power supply, but can alternatively also be operated using the mains power supply.

Figure 2:
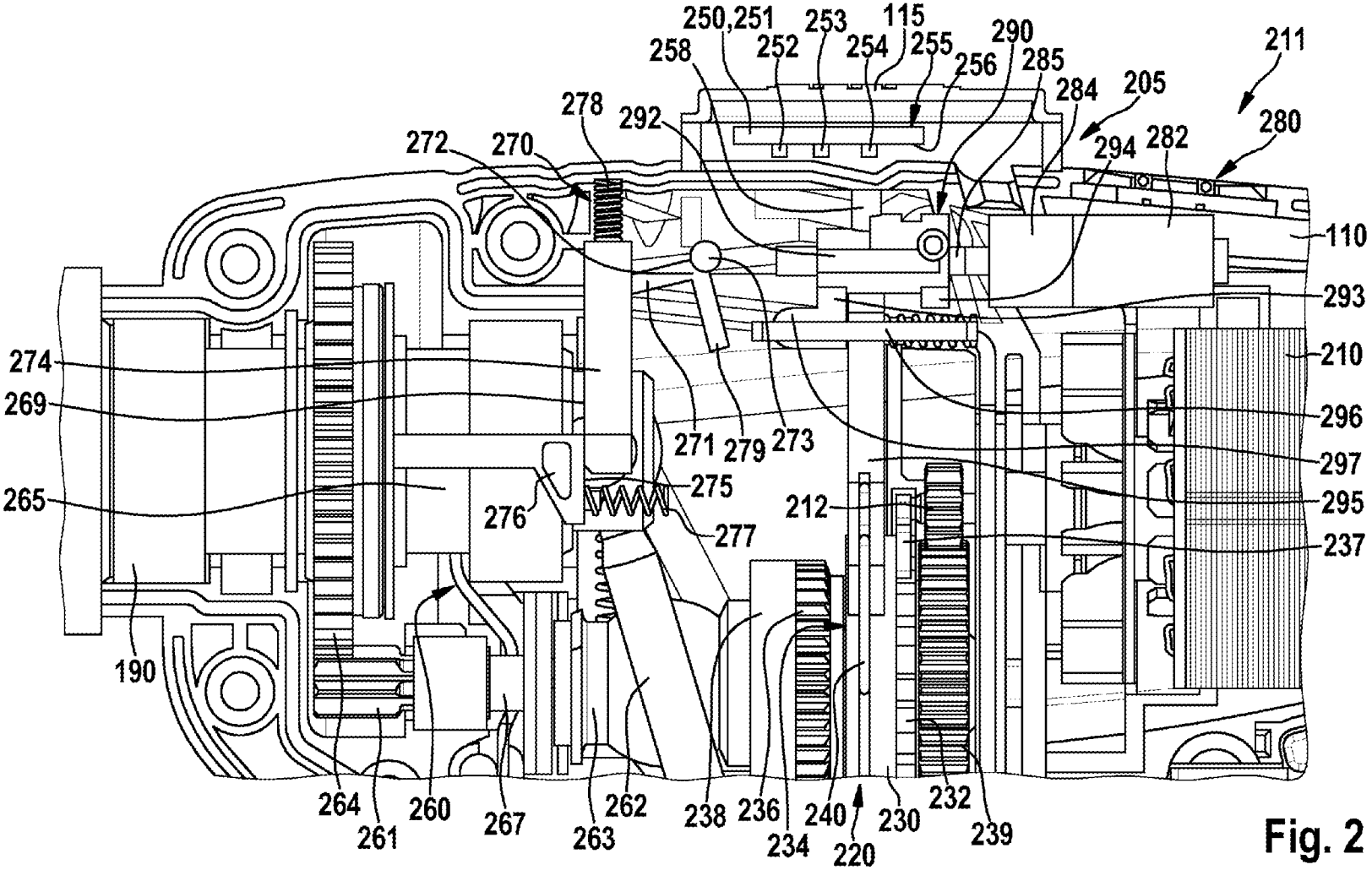
FIG. 2 shows a longitudinal section through the portable power tool from FIG. 1, with the shifting unit according to a first embodiment, to which an actuating element, a deflecting system according to a first embodiment, and a position detection element are assigned.

Preferably, the portable power tool 100 is configured in the form of a percussion drill or impact screwdriver and, for percussive driving of the application tool 109 in an associated percussive mode, has a percussion mechanism (260 in FIG. 2). Preferably, the percussion mechanism (260 in FIG. 2) is configured as a hammer percussion mechanism, preferably as a pneumatic percussion mechanism, in particular as a wobbling percussion mechanism.

Alternatively or additionally, the portable power tool 100 has a shiftable gearbox (220 in FIG. 2) which is shiftable at least between a first and second gear ratio.

In this case, the first gear ratio can correspond for example to a screwing mode and the second gear ratio can correspond to a drilling mode. However, further gear ratios can also be realized, such that, for example, a drilling mode with a low torque is assigned to the second gear ratio and a drilling mode with a high torque is assigned to a third gear ratio, etc. The gearbox (220 in FIG. 2) and also the drive motor (210 in FIG. 2) and the percussion mechanism (260 in FIG. 2) form preferably a drive unit (211 in FIG. 2) for driving the application tool 109.

According to one embodiment, the drive unit (211 in FIG. 2) is furthermore assigned a shifting unit 205, which is configured at least to shift the drive unit between the at least one non-percussive operating mode and the associated percussive mode, or to activate/deactivate the percussion mechanism (260 in FIG. 2). Preferably, the shifting unit 205 is configured to activate/deactivate the percussion mechanism (260 in FIG. 2) and/or to shift the shiftable gearbox (220 in FIG. 2) between at least two different gear ratios.

According to one embodiment, at least one user guidance unit 115 is provided, which is provided at least to activate/deactivate the percussion mechanism (260 in FIG. 2). The user guidance unit 115 can in this case be configured for active and/or passive user guidance during corresponding activation/deactivation of the percussion mechanism (260 in FIG. 2). In the case of active user guidance, a user of the portable power tool 100 is guided preferably by visual, auditory and/or haptic instructions or requirements for activation/deactivation, while in the case of passive user guidance, corresponding activation/deactivation is carried out automatically and is preferably merely indicated to the user. Exemplary realizations of active and passive user guidances are described in detail below.

Preferably, the user guidance unit 115 has at least one manually actuable control unit having at least one manually actuable control element 116, 117, preferably having three control elements (1821-1823 in FIG. 18), and in the illustration having a first and second manually actuable control element 116, 117. The, in the illustration, two control elements 116, 117 are preferably configured at least to initiate a shifting operation for activating/deactivating the percussion mechanism (260 in FIG. 2). It should be noted that the user guidance unit 115 can alternatively or additionally also be configured to shift the shiftable gearbox (220 in FIG. 2). Preferably, at least one of the two control elements 116, 117 can be configured in this case as a switch and/or button.

The user guidance unit 115 has preferably a mobile computer, for example a smartphone and/or a tablet computer, and/or the control element 116, 117 can be configured as a display. Alternatively, it is also possible for other smart devices, as they are known, for example a watch, spectacles etc. to be used as mobile computer. Furthermore, gesture control can also be used.

Figure 17:
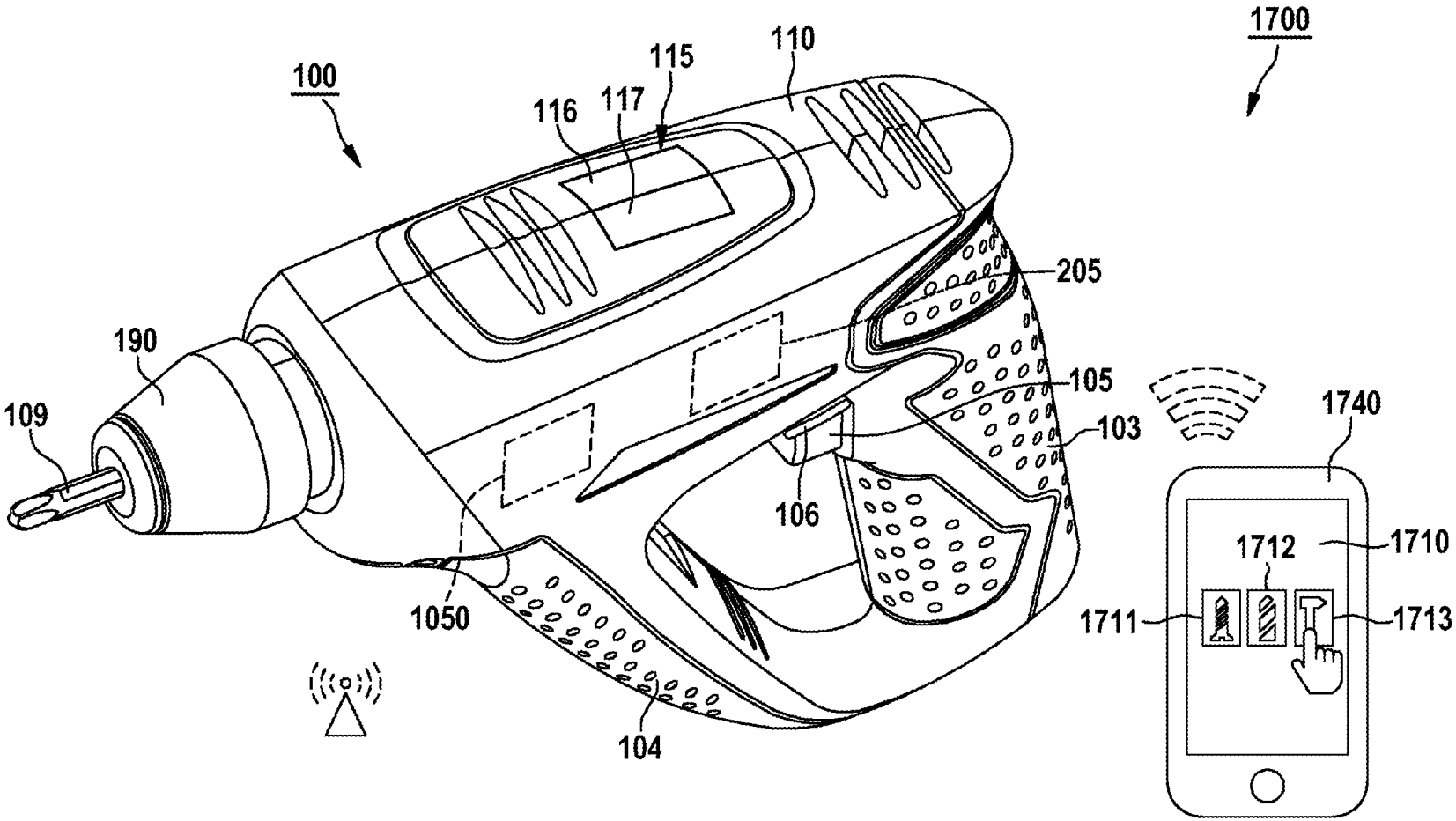
FIG. 17 shows a perspective view of a system consisting of the portable power tool from FIG. 1 and a control unit according to a first embodiment.

According to one embodiment, the user guidance unit 115 is integrated at least partially into the portable power tool 100 and/or configured at least partially as an external, separate component (1740 in FIG. 17). In this case, the display can be integrated into the portable power tool 100 and/or arranged externally. Preferably, shifting instructions can be indicated on the display, in order at least to make it easier for a user of the portable power tool 100 to operate and/or set for example an application-specific operating mode of the portable power tool 100.

Moreover, the portable power tool 100 preferably has a communication interface 1050, which is preferably provided for communication with the user guidance unit 115 that is actuable preferably by a user, and is configured at least to receive activation/deactivation instructions for activating/deactivating the percussion mechanism (260 in FIG. 2) and/or shifting instructions for the application-specific shifting of the gearbox (220 in FIG. 2) between the two different gear ratios from the user guidance unit 115. In this case, the communication interface 1050 is configured at least to send a control or actuation signal to at least one of the control elements 116, 117.

In this case, the control signal can be generated in response to an actuation of the at least one control element 116, 117. Alternatively or additionally, the generation of the control signal can be triggered preferably by the user guidance unit 115, i.e. for example by a mobile computer in the form of a smartphone or of a tablet computer, such that it is also possible to dispense with providing the control elements 116, 117. Furthermore, according to one embodiment, the generation can also be triggered directly by the communication interface 1050, for example depending on predetermined operating parameters, such that it is again possible to dispense with providing the control elements 116, 117.

Preferably, generation of a request for initiating an activation/deactivation operation for activating/deactivating the percussion mechanism (260 in FIG. 2) and/or for initiating a shifting operation for shifting the gearbox (220) between the two different gear ratios is made possible for example by at least one of the control elements 116, 117. According to one embodiment, the communication interface 1050 is configured in the manner of a wireless transmission module, in particular as a radio module for wireless communication by means of the Bluetooth standard. However, the transmission module can also be configured for any other, wireless and/or wired communication, for example via WLAN and/or LAN.

FIG. 2 shows the portable power tool 100 from FIG. 1 with a drive unit 211 for driving the application tool 109, having a drive motor 210. Preferably, the drive unit 211 is assigned at least one percussion mechanism 260, configured as a hammer percussion mechanism, in particular as a wobbling percussion mechanism, for the percussive drive of the application tool 109. The wobbling percussion mechanism 260 is preferably configured to convert a rotary movement of the drive unit 211 into an axial percussive pulse which is transmitted to the application tool 109 arranged in the tool receptacle 190 in FIG. 1.

The wobbling percussion mechanism 260 has, for this purpose, a wobble bearing 263, which is connected to a wobble finger 262, wherein the wobble bearing 263 transmits the rotary movement of the drive motor 210 to the wobble finger 262. In this case, the wobble finger 262 converts preferably the rotary movement into an axial percussive pulse and transmits the latter to a piston unit 265. The wobble bearing 263 is in this case connected preferably to a countershaft 267. During operation of the wobbling percussion mechanism 260, the wobble bearing 263 rotates relative to the wobble finger 262 and synchronously with the countershaft 267. Arranged at an end of the countershaft 267 that is close to the tool receptacle 190 is a drive element 261 that is configured in the illustration as a pinion for driving a gear 264 assigned to the wobbling percussion mechanism 260. The functioning principle of the wobbling percussion mechanism 260 and further details relating to components thereof are described in DE 10 2012 212 404 A1 and DE 10 2012 212 417 A1, the disclosures of which are explicitly included in the present description such that, for the purpose of conciseness of the description, a detailed description of the wobbling percussion mechanism 260 can be dispensed with here for the sake of conciseness of information. The percussion mechanism 260 configured preferably as a wobbling percussion mechanism is also referred to as "hammer percussion mechanism 260" in the following text.

In the non-percussive operating mode of the hammer percussion mechanism 260, or with the hammer percussion mechanism 260 deactivated, at least one, in the illustration a first and second deactivating element 274, 276 blocks the hammer percussion mechanism 260, or the piston unit 265, such that the piston unit 265 is axially blocked. For example, the first deactivating element 274 is arranged perpendicularly to a longitudinal axis of the drive motor 210 in the housing 110 and the second deactivating element 276 is arranged parallel to the longitudinal axis of the drive motor 210. Preferably, the first deactivating element 274 is urged away from the housing 110, or toward the hammer percussion mechanism 260, via a spring element 278, and the second deactivating element 276 is urged in the direction of the tool receptacle 190, or in the direction of the gear 264 of the hammer percussion mechanism 260, via a spring element 277. Preferably, the first deactivating element 274 has a blocking side 269 facing the second deactivating element 276, and the second deactivating element 276 has a blocking edge 275 facing the first deactivating element 274, wherein the blocking side 269 bears against the blocking edge 275 in the non-percussive operating mode and in this way the second deactivating element 276 prevents the piston unit 265 from moving axially.

Alternatively or additionally, the drive unit 211 has a shiftable gearbox 220. Preferably, the drive unit 211 has the hammer percussion mechanism 260 and the shiftable gearbox 220, wherein preferably an axis of rotation of the countershaft 267 of the hammer percussion mechanism 260 corresponds to an axis of rotation of the shiftable gearbox 220. In this case, a gear wheel 238 that is assigned to the gearbox 220 is connected to the hammer percussion mechanism 260, or are arranged on the countershaft 267. The shiftable gearbox 220 is preferably configured in the manner of a planetary gearbox and is preferably shiftable between at least two different gear ratios (G1, G2 in FIG. 3). According to one embodiment, the gearbox 220 has at least one, in the illustration three contours 232, 234, 236. Preferably, the first contour 232 is formed in the illustration on the side of the shifting ring gear 230 and arranged in a manner facing the drive motor 210, wherein preferably the first contour 232 is assigned to a contour element 237 with a mating contour. Preferably, the contour element 237 exhibits sheet metal. Furthermore, preferably the second contour 234 is assigned to the first gear ratio of the gearbox 220 and the third contour 236 is assigned to the second gear ratio, wherein the respective contours 234, 236 mesh with the shifting element 230. According to one embodiment, the shifting element 230 is configured in the manner of a shifting ring gear which is linearly movable between at least two shift positions (S, D in FIG. 3), wherein the at least two shift positions (S, D in FIG. 3) are assigned to the at least two different gear ratios (G1, G2 in FIG. 3). According to one embodiment, the shifting ring gear 230 is configured as a ring gear of a second planetary gear stage, but alternatively, the shifting ring gear 230 can also be configured as an additional shifting ring gear of the planetary gearbox 220. In this case, gear shifting is preferably also possible in a tooth-on-tooth arrangement between the shifting ring gear 230 and the planetary gearbox 220.

Furthermore, a drive element 239 is assigned to the gearbox 220, in the illustration on a side remote from the hammer percussion mechanism 260, or on a side close to the drive motor 210. Preferably, the drive element 239 meshes with an output element 212 of the drive motor 210. Preferably, the drive element 239 and the output element 212 are configured as pinions.

Furthermore, FIG. 2 illustrates the shifting unit 205 from FIG. 1, which is configured to activate/deactivate the hammer percussion mechanism 260 and/or to shift the shiftable gearbox 220. It should be noted that the shifting unit 205 can activate/deactivate the percussion mechanism, or the hammer percussion mechanism 260, and can shift the gearbox 220. However, the shifting unit 205 can also only activate/deactivate the hammer percussion mechanism 260 or only shift the gearbox 220. For the sake of simplicity and conciseness of the description, the shifting unit 205 is only described in the following text for activating/deactivating the hammer percussion mechanism 260 and for shifting the shiftable gearbox 220.

Preferably, the shifting unit 205 is assigned at least one actuating unit 280 having a servomotor 282 and a servomotor gearbox 284. Preferably, the communication interface 1050 is configured to transmit a control signal for activating the servomotor 282 to the servomotor 282. The actuating unit 280 is configured, in the non-percussive operating mode, to activate the hammer percussion mechanism 260 by shifting the drive unit 211 from the at least one non-percussive operating mode into the associated percussive mode, or, upon activation, to activate/deactivate the hammer percussion mechanism 260 and/or, upon activation, to shift the gearbox 220 between the two different gear ratios. For this purpose, the servomotor 282 is coupled to an activating element 297 preferably via an actuating element 292. Furthermore, the shifting unit 205 has an actuable shifting element 230, wherein the servomotor 282 is configured, upon activation, to actuate the actuable shifting element 230 for shifting the drive unit 211 between the at least one non-percussive operating mode and the associated percussive mode and/or for shifting the gear of the gearbox 220. Preferably, the actuating element 292 is configured to convert a rotary movement of the shaft 285 at least into a linear movement of the actuable shifting element 230.

In this case, the servomotor 282 is configured preferably to drive a shaft 285 on which the preferably linearly movable actuating element 292 is arranged. Preferably, the shaft 285 is configured in the manner of a threaded shaft which has, at least along a part of its axial extent, and preferably along its entire length, a constant thread pitch. In this case, the actuating element 292 is preferably arrangeable in at least two, in the illustration three shift positions (H, D, S in FIG. 3), which are preferably each assigned to an operating mode. In this case, at least a first shift position (S, D in FIG. 3) preferably corresponds to the at least one non-percussive operating mode, and a second shift position (H in FIG. 3) corresponds to the associated percussive mode. Preferably, the first shift position (S in FIG. 3) corresponds to a screwing mode with a preferably relatively slow speed of rotation of the application tool 109, the second shift position (D in FIG. 3) corresponds to a drilling mode with a relatively fast speed of rotation of the application tool 109, and a third shift position (H in FIG. 3) corresponds to the associated percussive mode, in particular a percussion drilling mode.

In order to detect a respectively current shift position of the actuating element 292, the actuating element 292 is preferably assigned a position detection element 258, which is linearly displaceable at least between a first and a second, preferably a first, second and third detection position. In this case, the first detection position is configured for detecting the first shift position (S in FIG. 3), the second detection position is configured for detecting the second shift position (D in FIG. 3), and the third detection position is configured for detecting the third shift position (H in FIG. 3). Alternatively, one shift position (S, D, H in FIG. 3) or one detection position of the actuating element 292 can be detected here and the two other shift positions are determined and/or arrived at via a time/current function. Preferably, the second shift position (D in FIG. 3) or the second detection position is detected here.

According to one embodiment, the position detection element 258 is assigned electronics 250 with at least one linear sensor 255 which is configured to detect a respectively current detection position of the position detection element 258. The linear sensor 255 is in this case arranged preferably on an underside 256, facing the position detection element 258, of a circuit board 251. Preferably, the linear sensor 255 is in this case assigned at least one, in the illustration three sensor elements 252, 253, 254. In the illustration, the position detection element 258 is arranged on the actuating element 292, but can also alternatively be arranged on the shaft 285. Furthermore, the shaft 285, which is preferably configured as a threaded shaft, can have, at least regionally, in the region of the linear sensor 255, a thread pitch that is different, greater or smaller, than the thread pitch otherwise provided along its axial extent, in order to allow application-specific setting of a linear movement of the actuating element 292. In this case, the actuating element 292 is arranged for example in the first shift position (S in FIG. 3) or the first detection position, wherein the sensor element 254 detects the position detection element 258.

According to one embodiment, in order to activate the hammer percussion mechanism 260, the activating element 297 is configured to release blocking of the hammer percussion mechanism 260 in a non-percussive operating mode by the two deactivating elements 274, 276. For this purpose, the activating element 297 can have an inclined plane (710 in FIG. 7) for axially displacing the at least one deactivating element 274, and/or the activating element 297 is assigned a deflecting system 270 for axially displacing the at least one deactivating element 274, and/or the activating element 297 is configured in the manner of an actuating unit (1620 in FIG. 16).

In the illustration, the activating element 297 is coupled to a deflecting system 270, wherein the deflecting system 270 is configured to activate and/or deactivate the hammer percussion mechanism 260. In this case, the activating element 297 is configured to release blocking of the hammer percussion mechanism 260 in a non-percussive operating mode by the two deactivating elements 274, 276. For this purpose, the deflecting system 270 is preferably assigned a deflecting element 272 which has a first and second limb element 271, 279, which are arranged at a predetermined angle to one another and which are connected together via a pivot point 273. Furthermore, the deflecting element 272 is arranged in a pivotable manner in the housing 110 via the pivot point 273. In the illustration, the first limb element 271 is arranged in a manner facing the first deactivating element 274, and the second limb element 279 is arranged in a manner facing the activating element 297. In this case, the pivot point 273 is preferably, in the illustration, above the activating element 297.

Upon activation of the hammer percussion mechanism 260, the deflecting element 272 is pivoted preferably in the clockwise direction. In the process, the actuating element 292 is arranged in the third shift position (H in FIG. 3), wherein the second limb element 279 is pivoted in the clockwise direction by the activating element 297. In this case, the first limb element 271 urges the first deactivating element 274 counter to a spring force of the spring element 278, or displaces the first deactivating element 274 in the direction of the housing 110, or its axial direction upward in the illustration. As a result, the second deactivating element 276 is enabled and the piston unit 265 of the hammer percussion mechanism 260 is enabled, or the percussive mode is set.

Upon deactivation of the hammer percussion mechanism 260, the actuating element 292 moves into the first or second shift position (S, D in FIG. 3), wherein the activating element 297 moves away from the second limb element 273. In the process, the two spring elements 278, 277 act on the deactivating elements 274, 276, which then move back into their starting position and block or deactivate the hammer percussion mechanism 260.

According to one embodiment, the control unit 115 is provided to set an operating mode, required during operation, by activating the servomotor 282 of the shifting unit 205. In this case, the servomotor 282 is able to be activated by actuation of the at least one control element 115. Furthermore, the communication interface 1050 from FIG. 1 is configured to transmit a control signal to the servomotor 282 in order to activate the servomotor 282.

Preferably, the shifting unit 205 has a transmission unit 290 which couples the actuating element 292 to the shifting ring gear 230 of the gearbox 220 and is configured to transmit a linear movement of the actuating element 292 to the linearly movable shifting ring gear 230. Preferably, the transmission unit 290 has in this case a shift rod 295, which is linearly displaceable by a linear movement of the actuating element 292. Preferably, the actuating element 292 is assigned a first and second stop element 293, 294, wherein the first stop element 293 is arranged facing the hammer percussion mechanism 260 and the second stop element 294 is arranged facing the drive motor 210. In this case, the shift rod 295 bears against the first stop element 293 in the first and second shift position (S, D in FIG. 3) and, in the third shift position (H in FIG. 3), the shift rod 295 bears against the second stop element 294. According to one embodiment, the shift rod 295 is arranged in a guide element 296 preferably connected to the actuating element 292.

Preferably, the transmission unit 290 connects the shifting ring gear 230 to the actuating element 292. Furthermore, the transmission unit 290 preferably has a shifting bracket 240, which connects the shift rod 295 and the shifting ring gear 230 together. In this case, the shifting ring gear 230 is preferably fixed only axially to the shifting bracket 240. Preferably, the shifting bracket 240 is configured as a wire bracket. It should be noted that the configuration of the transmission unit 290 with a shift rod 295 and a shifting bracket 240 is merely exemplary in nature and should not be considered as limiting the disclosure. Thus, the shift rod 295 can also be connected to the shifting ring gear 230 directly, i.e. without a shifting bracket 240.

Figure 3:
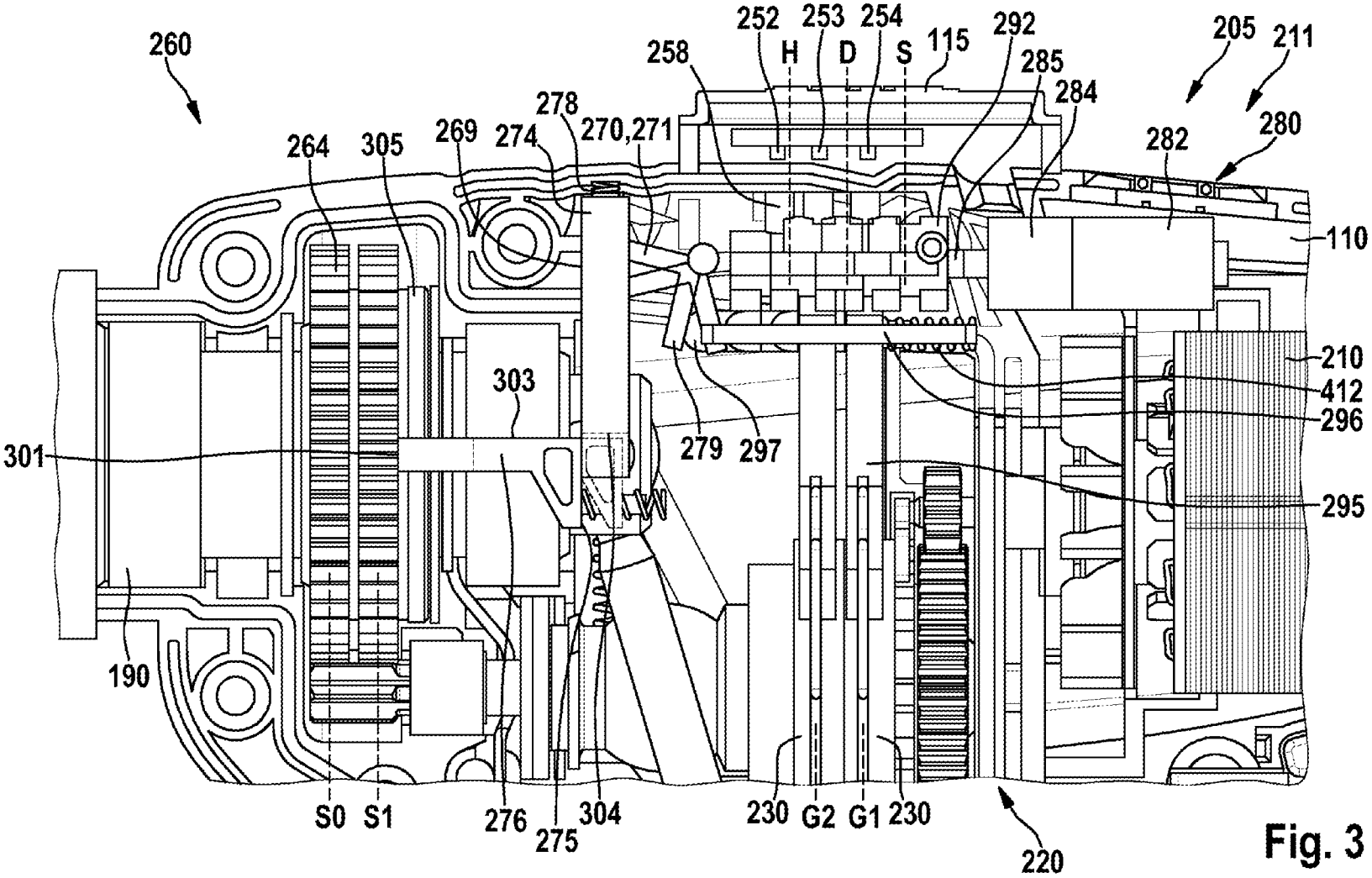
FIG. 3 shows a longitudinal section through the portable power tool from FIG. 1 and FIG. 2, with the actuating element from FIG. 2 in a first, second and third shift position.

FIG. 3 shows the drive unit 211 from FIG. 2 of the portable power tool 100 from FIG. 1 with the shifting unit 205 and illustrates an exemplary arrangement of the shifting unit 205, or of the actuating element 292, in at least two, in the illustration three operating modes or shift positions S, D, H. A first shift position S corresponds in this case to a first gear ratio G1 of the gearbox 220, which corresponds preferably to a relatively slow speed. Preferably, the first shift position S corresponds to a screwing mode.

In the first shift position S, or the first detection position, the actuating element 292 is preferably arranged on the shaft 285 such that the sensor element 254 detects the position detection element 258. In this case, a spring element 412 assigned to the transmission unit 290 urges the shift rod 295 into the first gear ratio G1, or against the first stop element 293 of the actuating element 292. As a result, the shifting ring gear 230 preferably meshes with the contour element 237, wherein a form fit preferably forms.

As a result of a linear movement of the actuating element 292 in the direction of the tool receptacle 190, the actuating element 292 moves preferably into a second shift position D. Preferably, the second shift position D corresponds to a second gear ratio G2 of the gearbox 220, which corresponds preferably to a relatively fast speed. Preferably, the second shift position D corresponds to a drilling mode.

Preferably, in the second shift position D, or the second detection position, the actuating element 292 is arranged on the shaft 285 such that the sensor element 253 detects the position detection element 258. In this case, the spring element 412 urges the shift rod 295 into the second gear ratio G2, or, analogously to the first shift position S, against the first stop element 293 of the actuating element 292. As a result, the shifting ring gear 230 preferably meshes with the third contour 236 of the gear wheel 238, wherein a form fit preferably forms.

As a result of a further linear movement of the actuating element 292 in the direction of the tool receptacle 190, the actuating element 292 moves preferably into a third shift position H. In this case, the third shift position H corresponds preferably to the second gear ratio G2 of the gearbox 220 and a percussive mode, or a position S1 of the hammer percussion mechanism 260. Preferably, the third shift position H corresponds to a percussion drilling mode, but can also correspond to a further percussion drilling mode, in which the gearbox 220 has been shifted into the first gear ratio G1.

If, during a shifting operation in the first and/or second shift position S and/or D, the shifting ring gear 230 and the gear wheel 238 are positioned with respect to one another such that they cannot mesh with one another, the shifting bracket 240 acts on the shifting ring gear 230 such that the two parts can engage in one another when the drive motor 210 is started up and can thus mesh with one another. Furthermore, the hammer percussion mechanism 260 is deactivated in the first and/or second shift position S, D, wherein the gear 264 assigned to the hammer percussion mechanism 260 is arranged in a position S0. In this position S0, an axial movement of the hammer percussion mechanism 260, or a percussive pulse, is blocked by the two deactivating elements 274, 276. In this case, the blocking side 269 of the first deactivating element 274 bears against the blocking edge 275 of the second deactivating element 276, wherein the second deactivating element 276 prevents, with its side 301 facing the tool receptacle 190, an axial movement of a support element 305 assigned to the hammer percussion mechanism 260, and thus blocks any axial movement of the piston unit 265, or a percussive impulse of the hammer percussion mechanism 260. The support element 305 is configured preferably as a needle bearing, which is configured to decouple the second deactivating element 276 from the gear 264.

In the third shift position H, or the third detection position, the actuating element 292 is preferably arranged on the shaft 285 such that the sensor element 252 detects the position detection element 258. In this case, a spring element 412 assigned to the transmission unit 290 urges the shift rod 295 into the second gear ratio G2 and the activating element 297 assigned to the actuating element 292 rotates the deflecting element 272 preferably in the clockwise direction. In this case, the first limb element 271, as described above, is pivoted counter to the spring force of the spring element 278 against the first deactivating element 274, or it moves the first deactivating element 274 in the direction of the housing 110. As a result, the second deactivating element 276 is enabled, wherein an underside 304, facing the countershaft 267 of the hammer percussion mechanism 260, of the first deactivating element 274 is arranged on a top side 303, facing the first deactivating element 274, of the second deactivating element 276. As a result, the tool receptacle 190, including the gear 264, obtains an axial degree of freedom. In this case, an axial force is introduced via the application tool 109 into the tool receptacle 190, which, together with the gear 264, moves in the direction of the drive motor 210, or into the position S1, and thus activates the hammer percussion mechanism 260.

Upon deactivation of the hammer percussion mechanism 260, or an arrangement of the actuating element 292 from the third shift position H into the first or second shift position S, D, the activating element 297 moves away from the second limb element 273. In the process, the two spring elements 278, 277 act on the deactivating elements 274, 276, which then move back into their starting positions and deactivate the hammer percussion mechanism 260, or move the gear 264 axially in the direction of the tool receptacle 190 and thus arrange it in the position S0.

Figure 4:
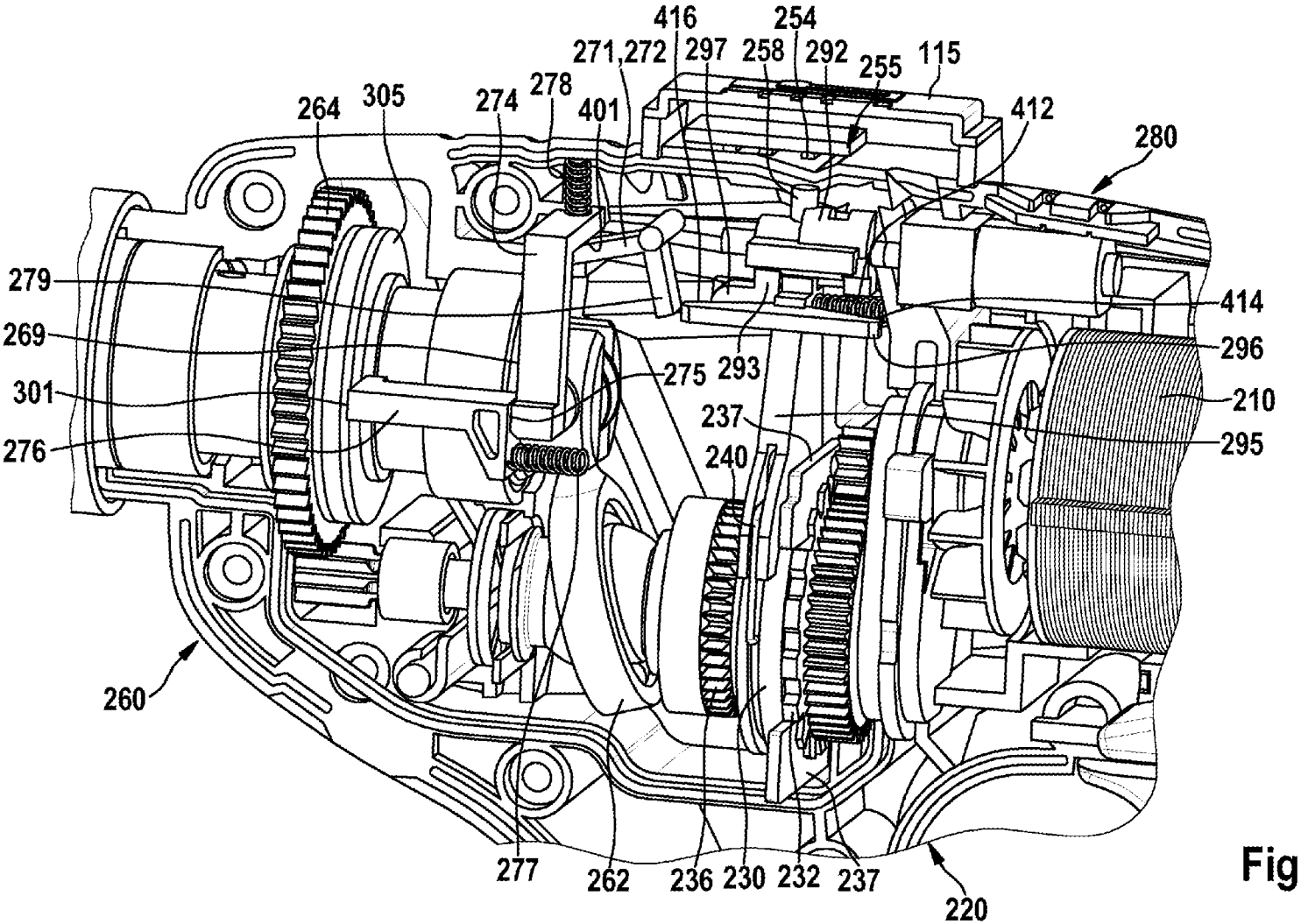
FIG. 4 shows a perspective partial view of the portable power tool from FIG. 3, with the actuating element in the first shift position.

FIG. 4 shows the portable power tool 100 from FIG. 1 to FIG. 3 with the drive unit 211 and the shifting unit 205 in the first shift position S. In the first shift position S, as described above, the sensor element 254 detects the position detection element 258 and the spring element 412 urges the shift rod 295 into the first gear ratio G1, or against the first stop element 293 of the actuating element 292.

Here, FIG. 4 illustrates the guide element 296, which has an H-shaped main body with a recess 416 facing the hammer percussion mechanism 260, and a recess 414 facing the drive motor 210. Preferably, the spring element 412 is arranged in the recess 414 and the activating element 297 is arranged in the recess 416. Furthermore, the shift rod 295 is assigned to the guide element 296, and preferably formed integrally therewith. In this case, FIG. 4 illustrates the exemplary configuration of the shift rod 295 with a preferably approximately triangular main body. Preferably, the shift rod 295 has, in the region of its end facing the shifting ring gear 230, a recess 422 for arranging the shifting bracket 240. In this case, the shifting bracket 240 preferably connects the shift rod 295 and the shifting ring gear 230 together such that, in a tooth-on-tooth arrangement of the shifting ring gear 230 with the gearbox 220, the shifting ring gear 230 is preloaded in the direction of the set shift position by the shifting bracket 240.

Furthermore, FIG. 4 illustrates an exemplary configuration of the contour element 237, which preferably forms a form fit with the first contour 232 of the shifting ring gear 230 in the first shift position S. In this case, the shifting ring gear 230 preferably meshes with the second contour 234 of the gearbox 220. Furthermore, FIG. 4 shows the first deactivating element 274, which preferably has an L-shaped main body, wherein the second limb element 271 bears against a bottom edge 401, facing the limb element 271, of the first deactivating element 274.

Figure 5:
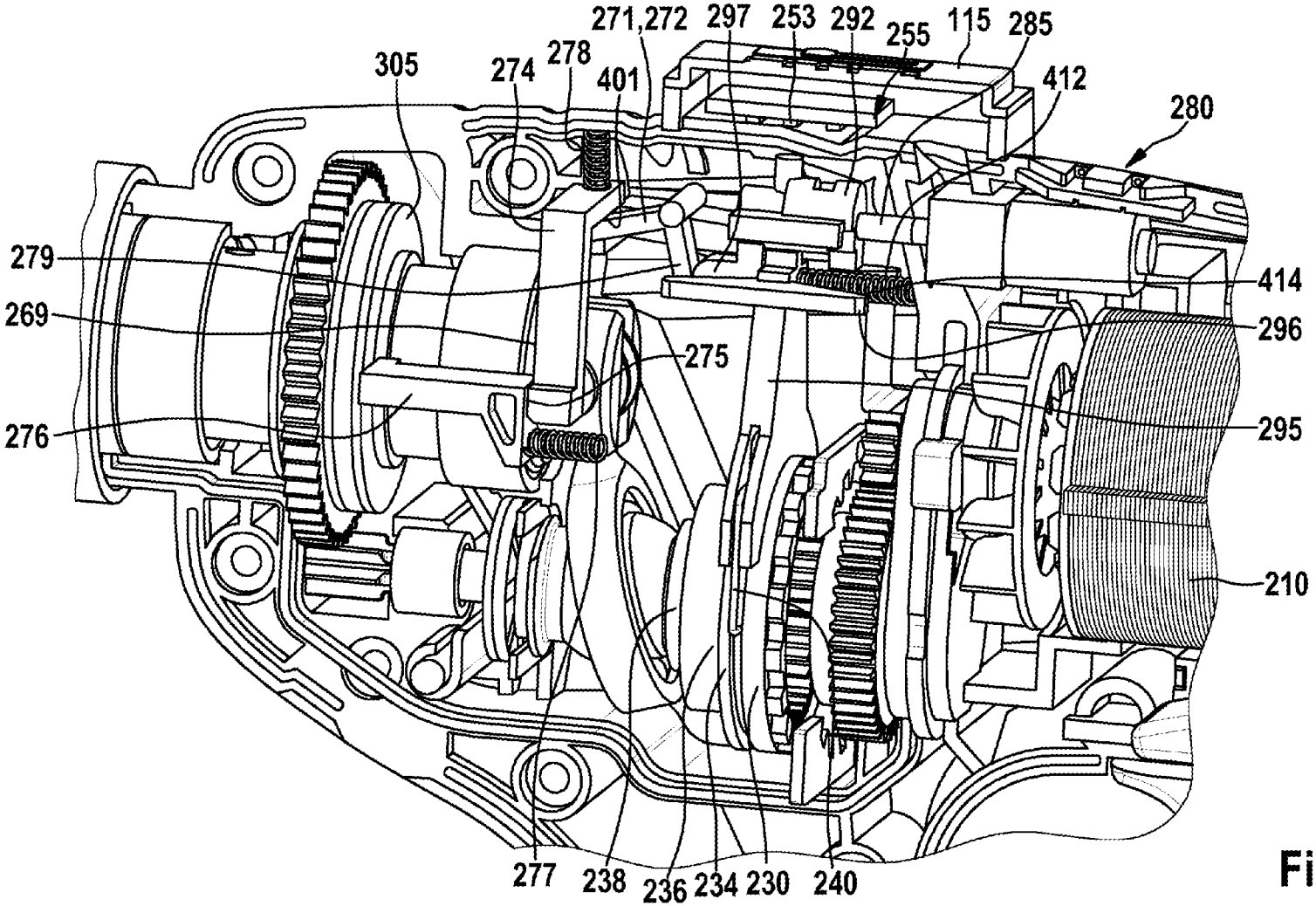
FIG. 5 shows a perspective partial view of the portable power tool from FIG. 3, with the actuating element in the second shift position.

FIG. 5 shows the portable power tool 100 from FIG. 1 to FIG. 3 with the drive unit 211 and the shifting unit 205 in the second shift position D. In the second shift position D, as described above, the sensor element 253 detects the position detection element 258 and the spring element 412 urges the shift rod 295 into the second gear ratio G2, or against the first stop element 293 of the actuating element 292. In the second gear ratio G2, the shifting ring gear 230 meshes with the third contour 236.

Figure 6:
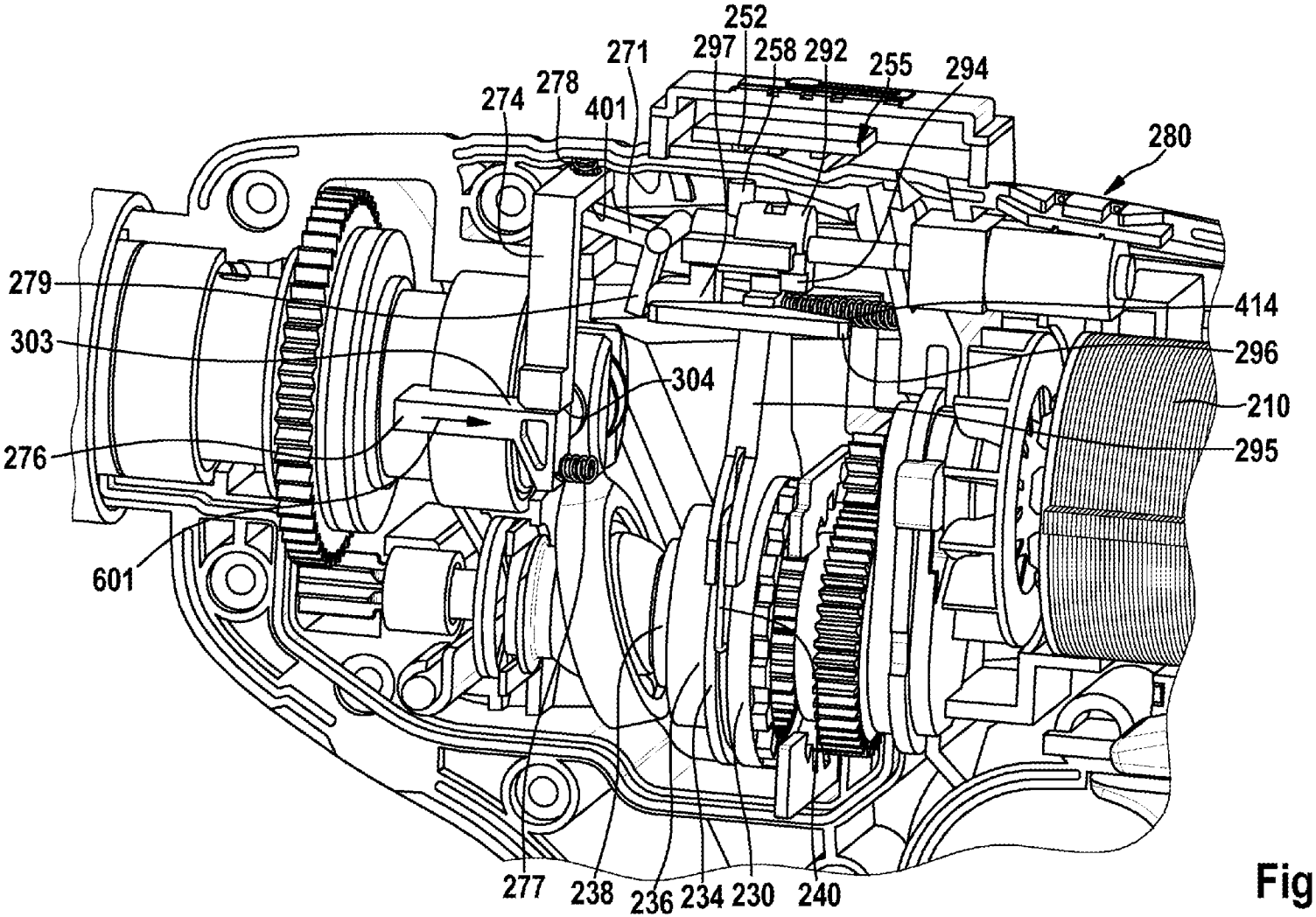
FIG. 6 shows a perspective partial view of the portable power tool from FIG. 3, with the actuating element in the third shift position.

FIG. 6 shows the portable power tool 100 from FIG. 1 to FIG. 3 with the drive unit 211 and the shifting unit 205 in the third shift position H. In the third shift position H, as described above, the sensor element 252 detects the position detection element 258, the spring element 412 urges the shift rod 295 into the second gear ratio G2, and the activating element 297 rotates the deflecting element 272 in order to activate the hammer percussion mechanism 260. In this case, as described above, the first limb element 271 is pivoted counter to the spring force of the spring element 278 against the first deactivating element 274, or the first deactivating element 274 is pushed in the direction of the housing 110, upward in the illustration. As a result, the second deactivating element 276 is enabled, or moved in the direction of the drive motor 210 in the direction of an arrow 601. With the hammer percussion mechanism 260 activated, the underside 304 of the first deactivating element 274 is arranged on the top side 303 of the second deactivating element 276. Furthermore, the shift rod 295 is preferably fixed between a housing stop and the second stop element 294.

Figure 7A:
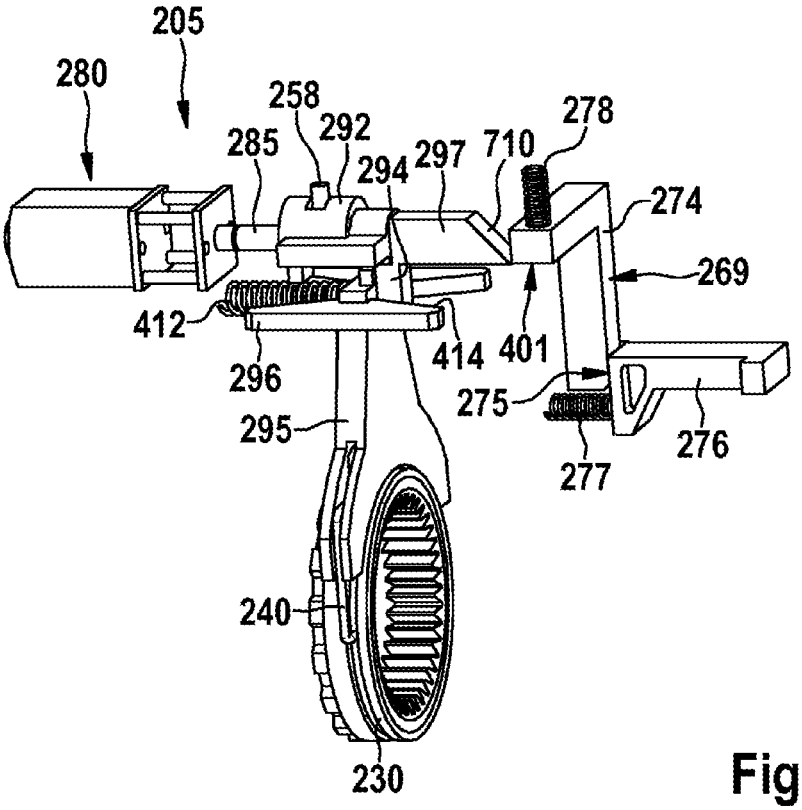
FIG. 7*a* shows a perspective side view of the shifting unit from FIG. 1 to FIG. 6, with an activating element according to a first embodiment in a first actuation position.

FIG. 7*a* shows the shifting unit 205 from FIG. 2 with the actuating element 292 and the activating element 297, which alternatively or additionally has an inclined plane 710 for the axial displacement of the first deactivating element 274. As a result of the configuration of the activating element 297 with the inclined plane 710, it is possible to dispense with the deflecting element 272, since the underside 401 of the first deactivating element 274 is movable in the direction of the housing 110 via the inclined plane 710 in order to activate the hammer percussion mechanism 260. In this case, FIG. 7*a* illustrates the shifting unit 205 with the hammer percussion mechanism 260 deactivated, or in the first or second shift position S, D.

Figure 7B:
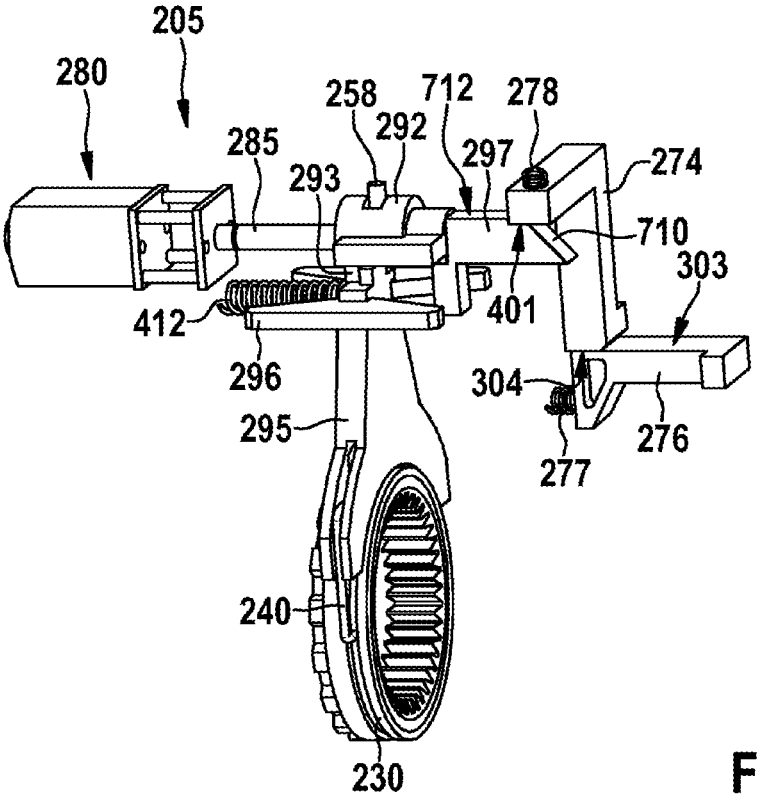
FIG. 7*b* shows a perspective side view of the shifting unit from FIG. 7*a* in a second actuation position.

FIG. 7*b* shows the shifting unit 205 from FIG. 2 with the activating element 297 from FIG. 7*a* with the hammer percussion mechanism 260 activated. In this case, the first deactivating element 274 is arranged on a top side 712 of the activating element 297 by having been displaced over the inclined plane 710 with its underside 401, or has been displaced in the direction of the housing 110, upward in the illustration. As a result, the second deactivating element 276 has enabled or activated the hammer percussion mechanism 260.

Figure 8:
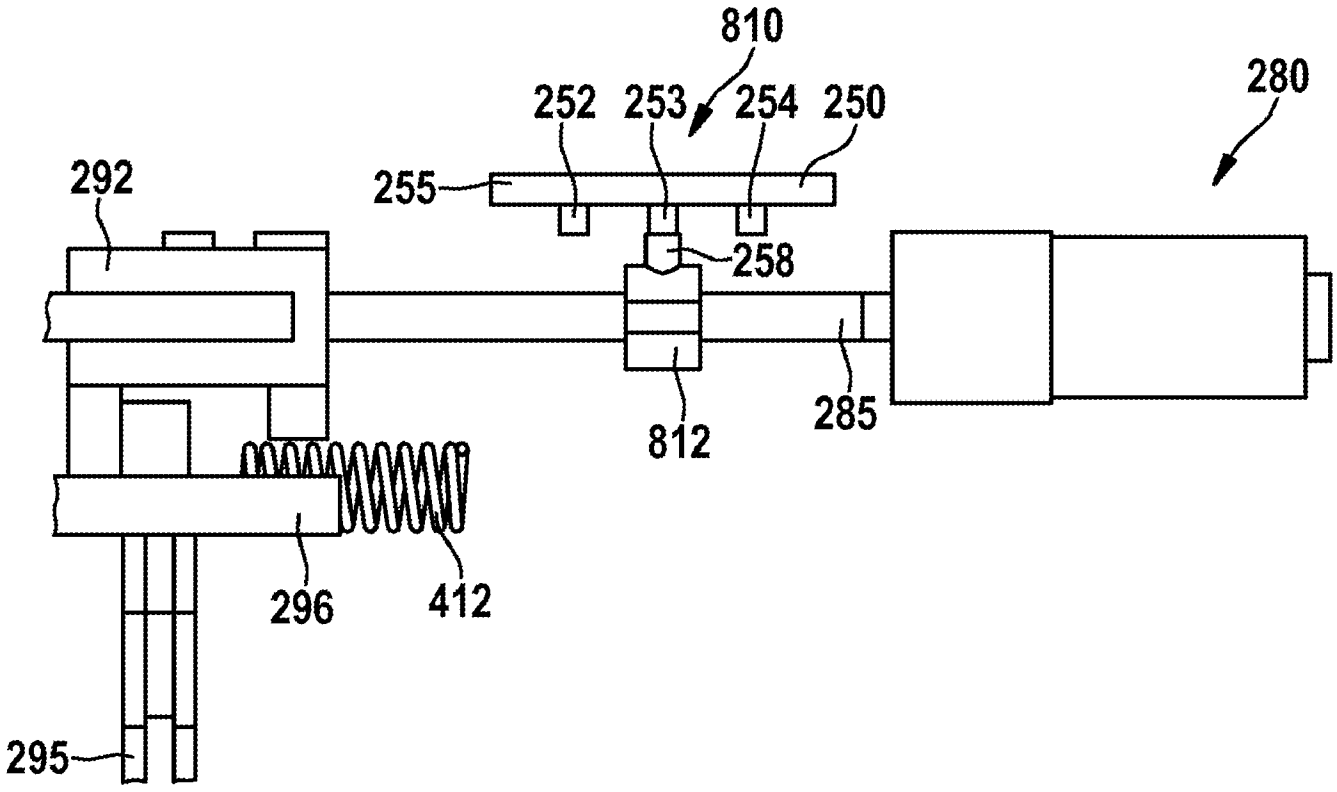
FIG. 8 shows a perspective partial view of the shifting unit from FIG. 7*b* with a position detection element according to an alternative arrangement variant.

FIG. 8 shows the actuating unit 280 from FIG. 2 with the shaft 285 and the actuating element 292. According to a further embodiment, in this case the position detection element 258 is arranged on the shaft 285 via a linearly movable holding element 812. In this case, preferably the holding element 812 and the position detection element 258 form a position detection unit 810.

Figure 9:
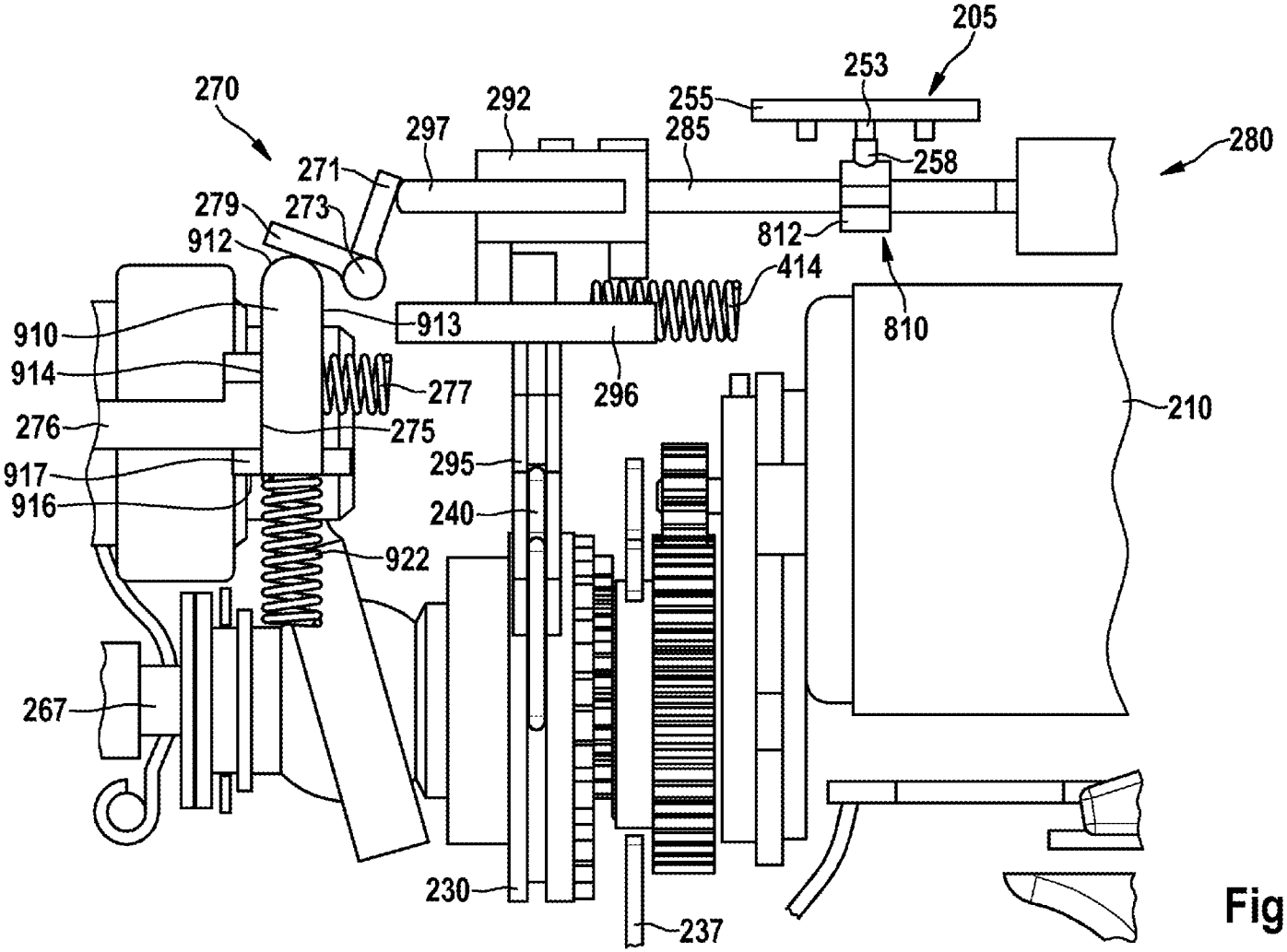
FIG. 9 shows a perspective side view of the shifting unit with the position detection element from FIG. 8 and a deflecting system according to a second embodiment.

FIG. 9 shows the shifting unit 205 from FIG. 2 with the position detection unit 810 from FIG. 8 and a deflecting system 270 having a first deactivating element 910 configured according to a further embodiment. Analogously to the deflecting system from FIG. 2 to FIG. 6, the deflecting system 270 has the deflecting element 272 with its two limb elements 271, 279, but the deflecting element 272 is arranged the other way round, or arranged in a rotated manner such that, by pivoting counterclockwise, it displaces the first deactivating element 910, downward in the illustration. In this case, the pivot point 273 of the deflecting element 272 is located preferably beneath the activating element 297 in the illustration.

Preferably, the first deactivating element 910 is provided with an elongate main body which has a first, in the illustration upper, and a second, in the illustration lower, end 912, 916, and a side 914 facing the tool receptacle 190, and a side 913 facing the drive motor 210. Furthermore, the first deactivating element 910 has, at its second end 916, a receiving web 917 for supporting the second deactivating element 276, which bears, preferably with its blocking edge 275, on the side 914 of the first deactivating element 910. Furthermore, the first deactivating element 910 is acted on via a spring element 922 arranged at its second end 916.

In the illustration, the actuating element 292 is arranged in the second shift position D, in which the activating element 297 bears on the deflecting element 272. In the case of an arrangement of the actuating element 292 in the third shift position H, the activating element 297 rotates the deflecting element 272, counterclockwise in the illustration. In the process, the second limb element 279 of the deflecting element 272 displaces the first deactivating element 910 at its first end 912 in the direction of the countershaft 267, or downward in the illustration, wherein the spring element 922 is compressed and the second deactivating element 276 can move in the direction of the drive motor 210, or to the right in the illustration, and thus enables the hammer percussion mechanism 260.

Figure 10:
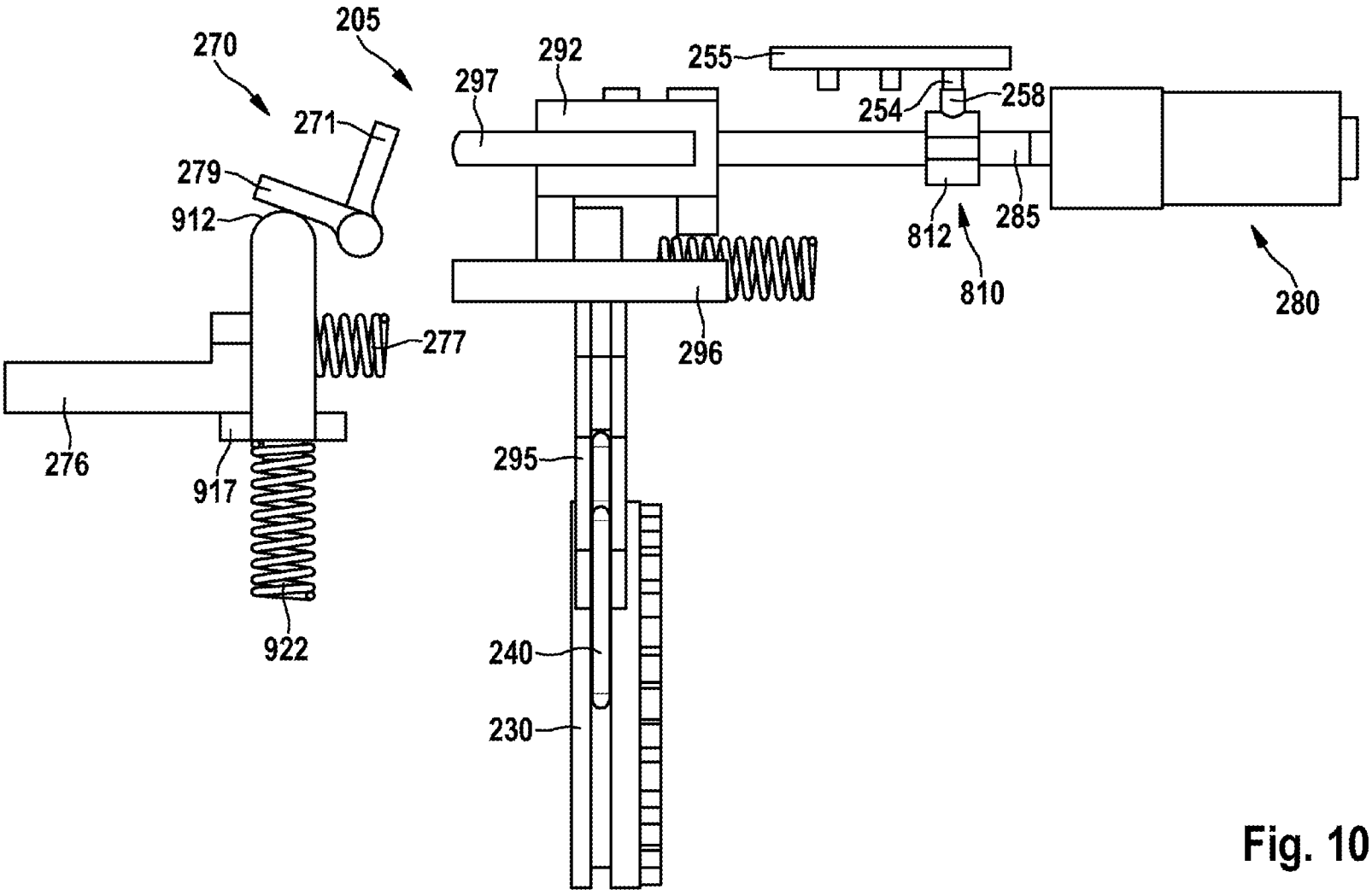
FIG. 10 shows a perspective side view of the shifting unit with the position detection element and the deflecting system from FIG. 9 in the first shift position.

FIG. 10 shows the shifting unit 205 from FIG. 2 with the deflecting system 270 from FIG. 9 with the deactivating element 910. In this case, the actuating element 292 is arranged in the first shift position S, wherein the activating element 297 is spaced apart from the deflecting element 272.

Figure 11:
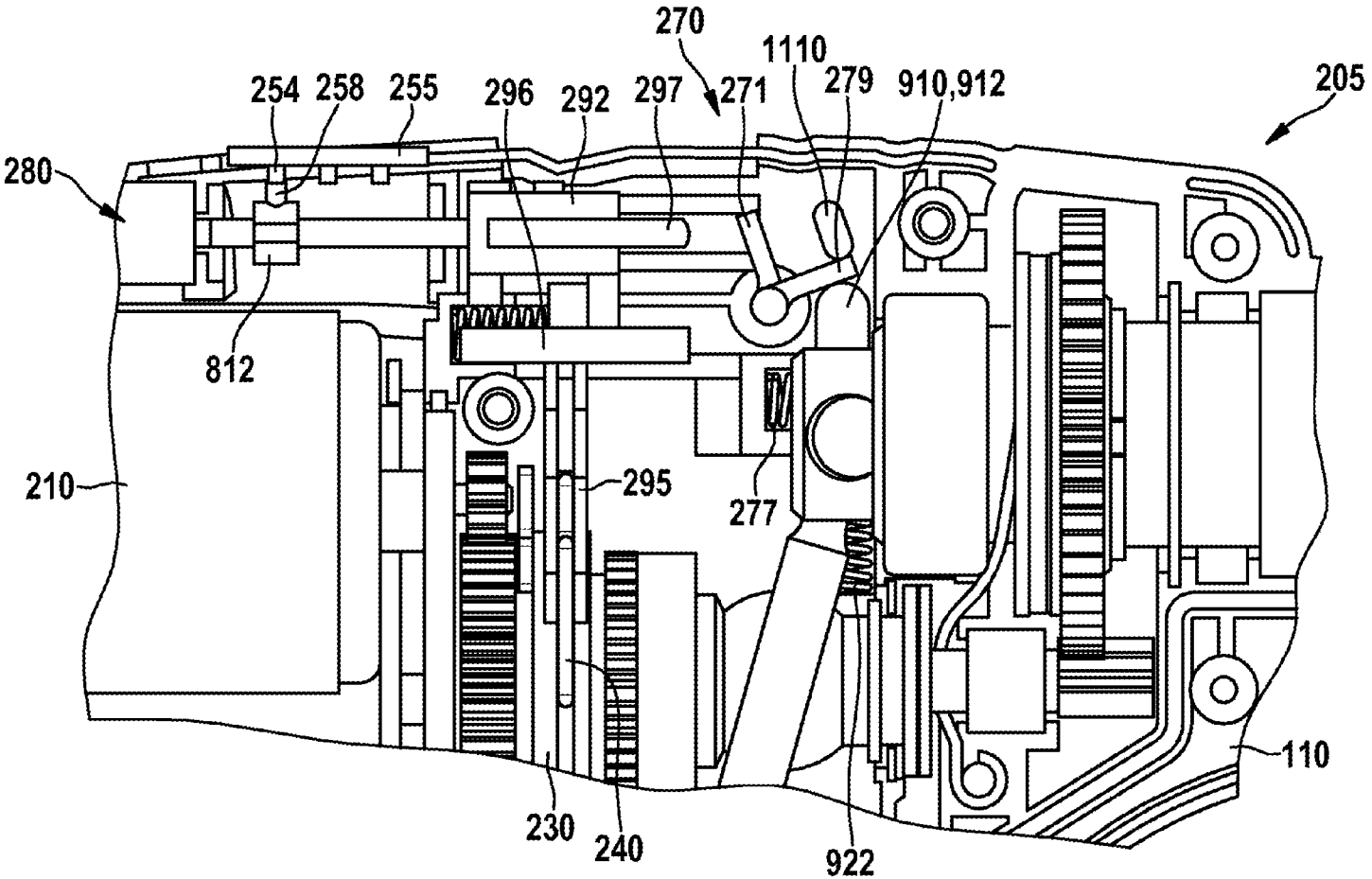
FIG. 11 shows a perspective partial view of the portable power tool from FIG. 1 with the shifting unit from FIG. 10 in the first shift position.

FIG. 11 shows the shifting unit 205 from FIG. 2, arranged in the housing 110, with the deflecting system 270 from FIG. 9 and FIG. 10. In this case, FIG. 11 illustrates a rest element 1110, arranged preferably in the housing 110, on which the limb element 279 of the deflecting element 272 rests preferably with the hammer percussion mechanism 260 deactivated.

Figure 12:
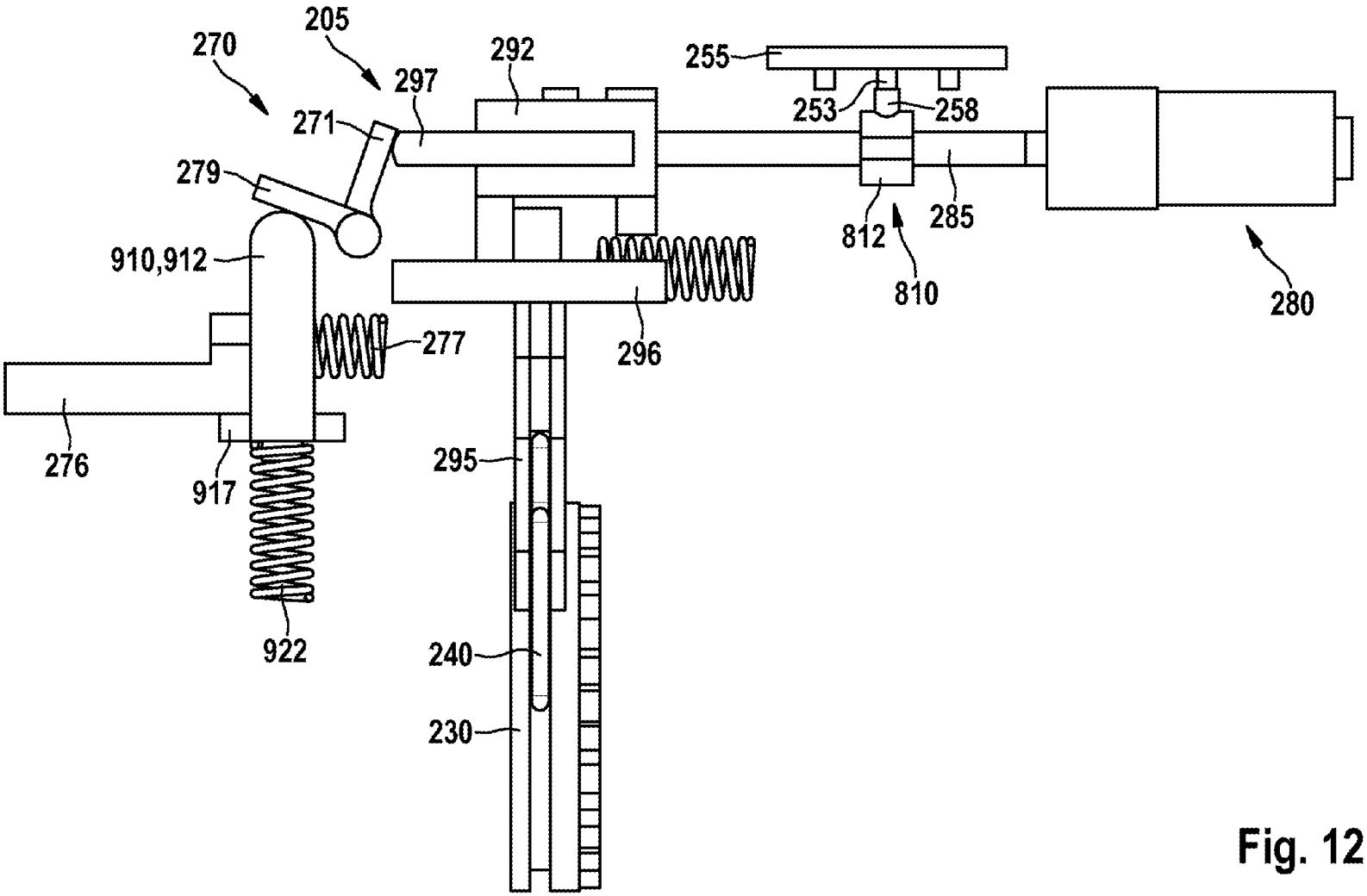
FIG. 12 shows a perspective side view of the shifting unit from FIG. 10 in the second shift position.

FIG. 12 shows the shifting unit 205 from FIG. 2 with the deflecting system 270 from FIG. 9 to FIG. 11 with the deactivating element 910. In this case, the actuating element 292 is arranged in the second shift position D, wherein the activating element 297 bears preferably on the deflecting element 272.

Figure 13:
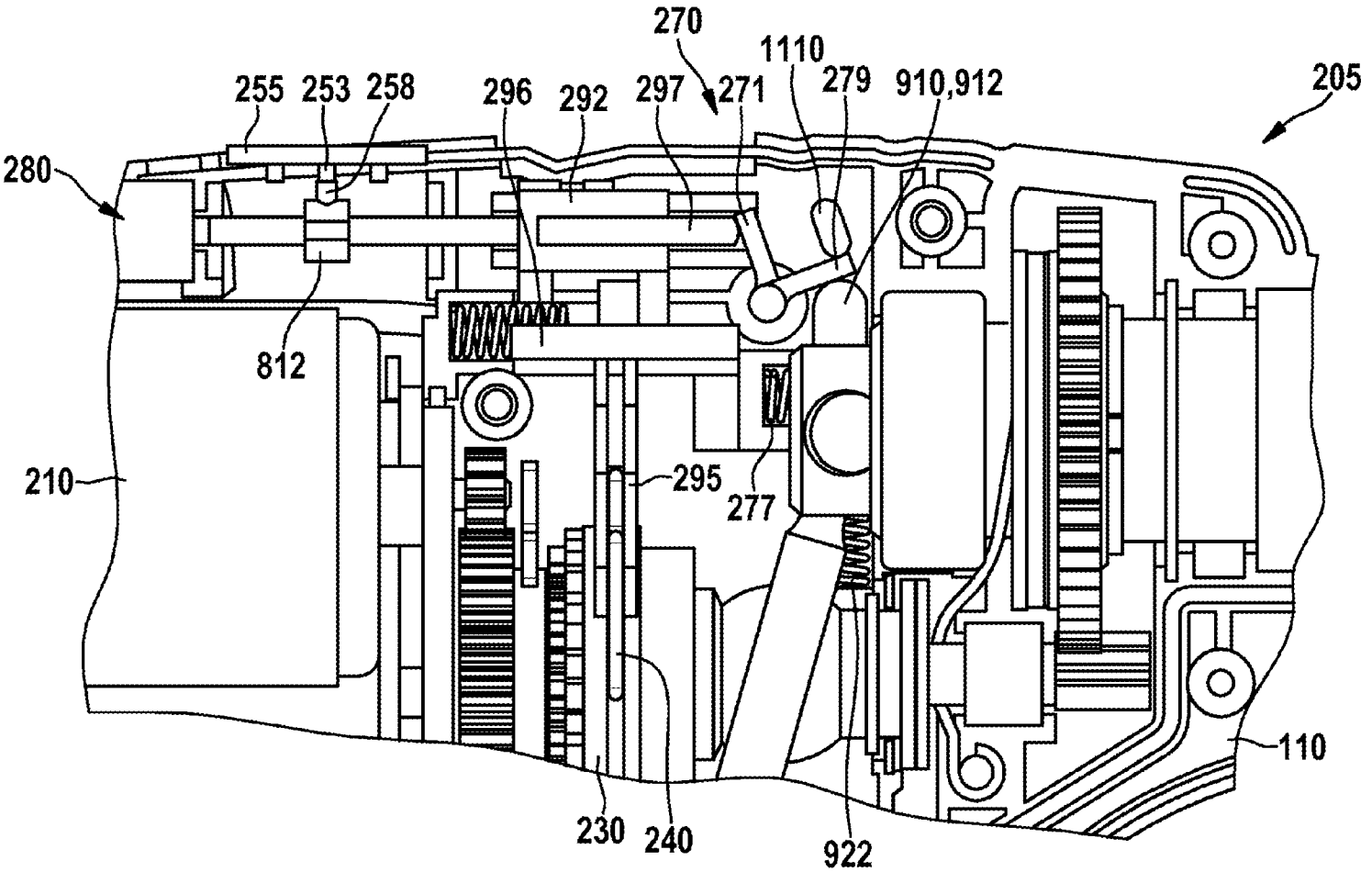
FIG. 13 shows a perspective partial view of the portable power tool from FIG. 1 with the shifting unit from FIG. 11 in the second shift position.

FIG. 13 shows the shifting unit 205 from FIG. 2, arranged in the housing 110 from FIG. 1, with the deflecting system 270 from FIG. 12. In this case, the actuating element 292 is arranged in the second shift position D, wherein the activating element 297 bears on the deflecting element 272 and the limb element 279 of the deflecting element 272 rests on the rest element 1110.

Figure 14:
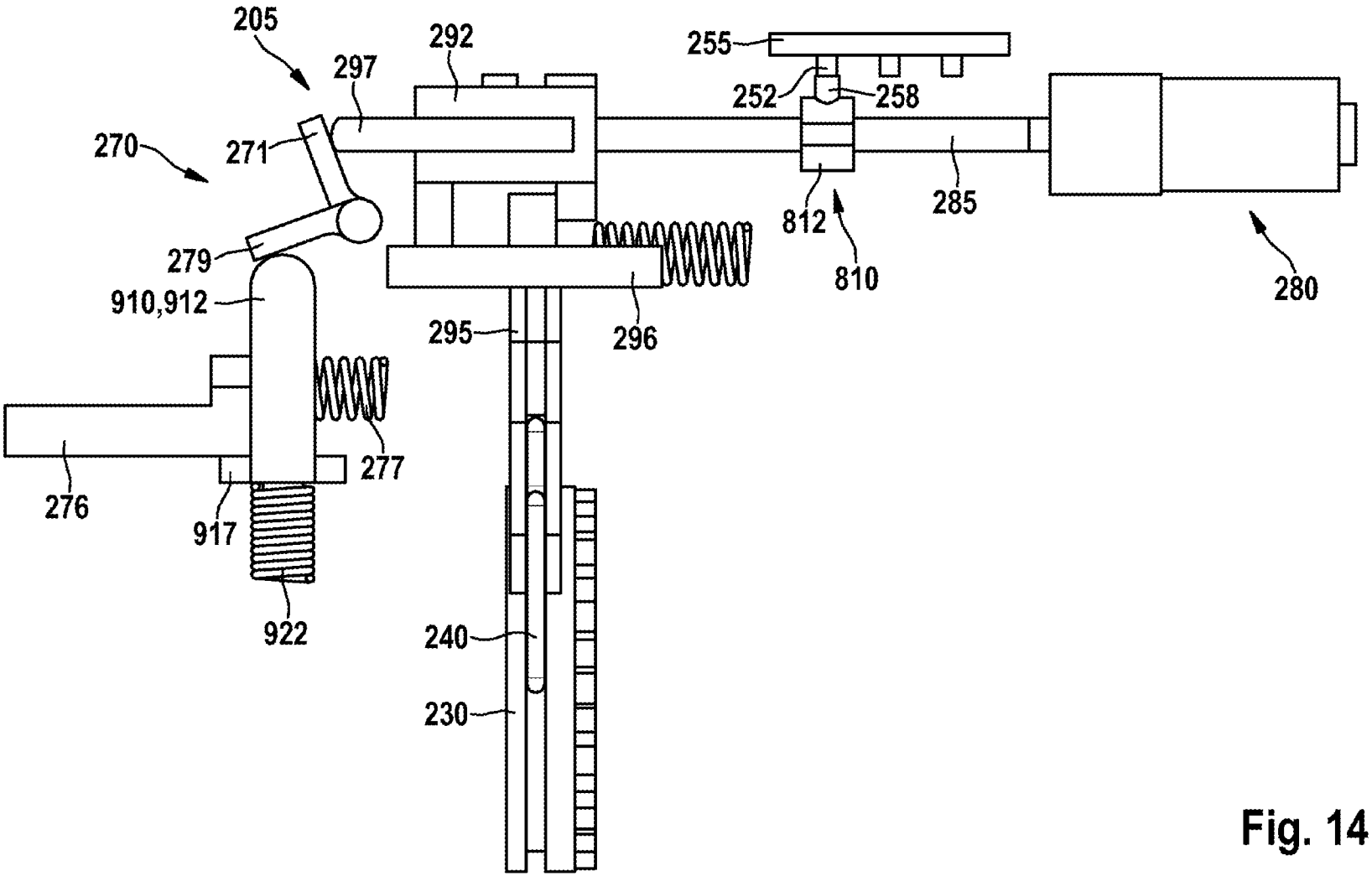
FIG. 14 shows a perspective side view of the shifting unit from FIG. 10 and FIG. 12 in the third shift position.

FIG. 14 shows the shifting unit 205 from FIG. 2 with the deflecting system 270 from FIG. 9 to FIG. 13 with the deactivating element 910. In this case, the actuating element 292 is arranged in the third shift position H, wherein the activating element 297 acts on and thus rotates the deflecting element 272 at the limb element 271 thereof. In the process, the first deactivating element 910 is displaced in the direction of the countershaft 267, and the second deactivating element 276 can move in the direction of the drive motor 210 and thus enable the hammer percussion mechanism 260.

Figure 15:
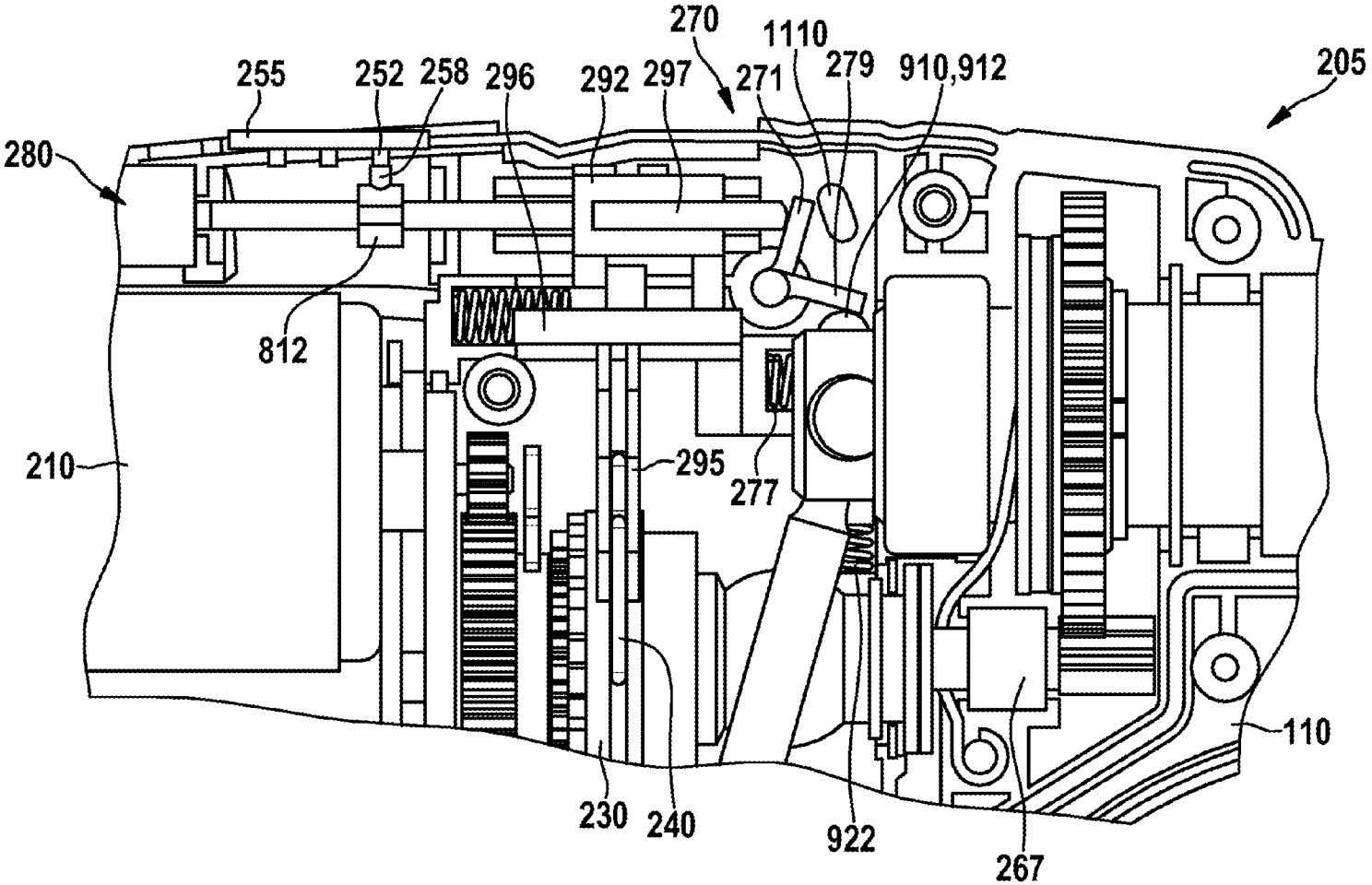
FIG. 15 shows a perspective partial view of the portable power tool from FIG. 1 with the shifting unit from FIG. 11 and FIG. 13 in the third shift position.

FIG. 15 shows the shifting unit 205 from FIG. 2, arranged in the housing 110 from FIG. 1, with the deflecting system 270 from FIG. 14. In this case, the actuating element 292 is arranged in the third shift position H, wherein the activating element 297 acts on the first deactivating element 910 via the deflecting element 272 and enables or activates the second deactivating element 276 and thus the hammer percussion mechanism 260.

Figure 16:
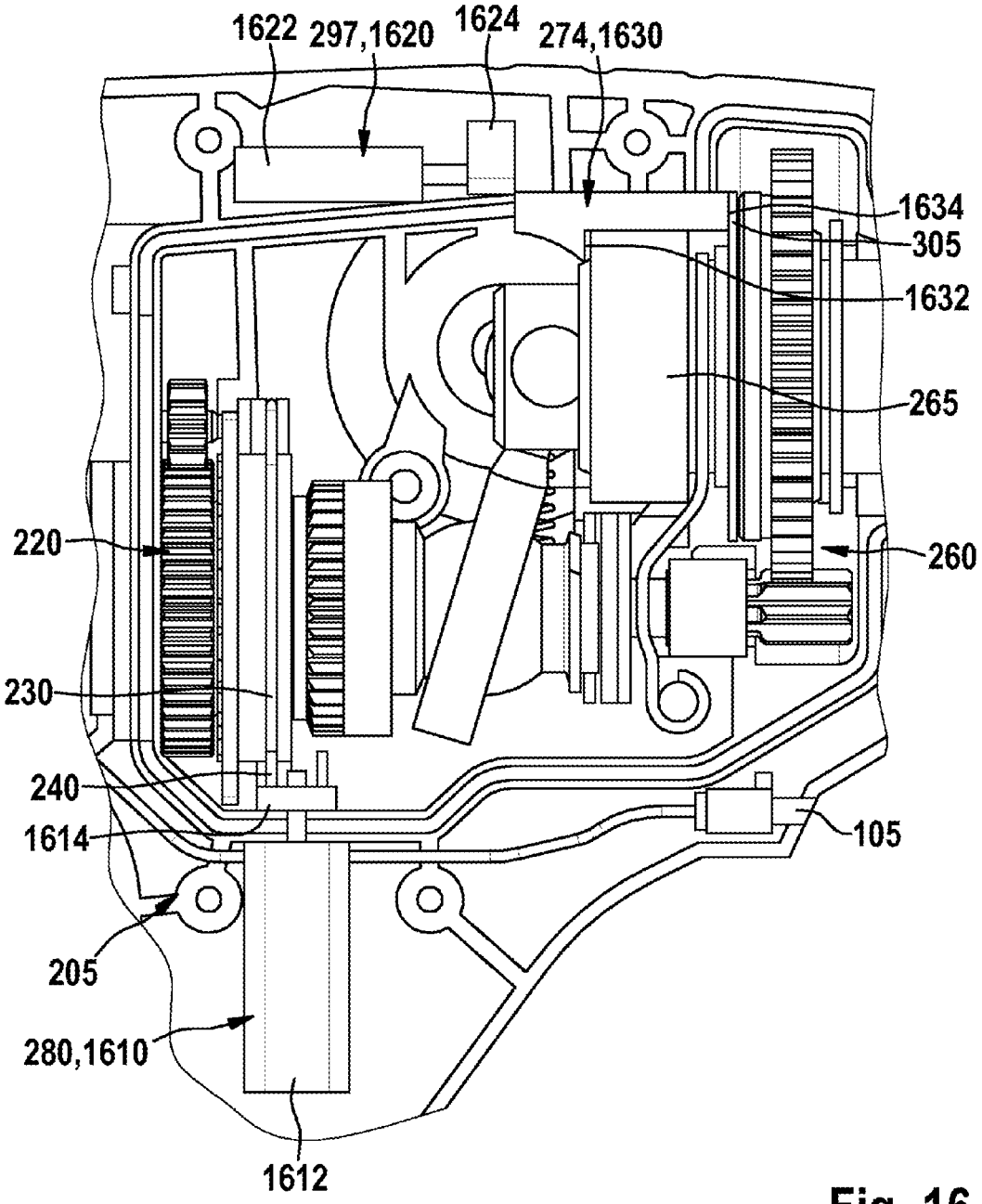
FIG. 16 shows a perspective side view of the portable power tool from FIG. 1 with a shifting unit according to a second embodiment.

FIG. 16 shows the shifting unit 205 from FIG. 2, configured in accordance with a further embodiment, which is provided with a first and a second actuating unit 1610, 1620. In this case, the two actuating units 1610, 1620 each preferably have a separate servomotor 1612, 1622 and a respectively associated servomotor gearbox 1614, 1624. Preferably, the first actuating unit 1610 is configured for gear shifting of the gearbox 220. In this case, the servomotor gearbox 1614 displaces the shifting ring gear 230 for gear shifting preferably via the shifting bracket 240.

Furthermore, the second actuating unit 1620 is configured preferably as an activating element 297 for the hammer percussion mechanism 260. In this case, the second actuating unit 1620 displaces a deactivating element 274 or 1630 in order to activate/deactivate the hammer percussion mechanism 260. For this purpose, the deactivating element 1630 has an elongate main body with a first and a second blocking edge 1632, 1634. In the illustration, the first blocking edge 1632 is arranged in the region of the piston unit 265 of the hammer percussion mechanism 260, and the second blocking edge 1634 is arranged in the region of the support element 305. In this case, at least one blocking edge 1632, 1634 blocks the hammer percussion mechanism 260 in the non-percussive operating mode.

FIG. 17 shows the portable power tool 100 from FIG. 1 with the communication interface 1050 and the user guidance unit 115 from FIG. 1. Alternatively or additionally, the user guidance unit 115 can, as described above, be configured at least partially as an external, separate component 1740. In this case, the external component 1740 has preferably a mobile computer, in particular of the smartphone and/or tablet-computer type. Alternatively, it is also possible for other "smart devices", for example a watch, spectacles etc. to be used as a mobile computer. Furthermore, gesture control can also be used. In this case, it is preferably also possible to dispense with providing the control elements 116, 117 or a control unit (1820 in FIG. 18), in particular if these can be realized by the mobile computer. In order to display a set operating mode, the portable power tool 100 preferably has a display. Preferably, the user guidance unit 115 in this case forms a tool system 1700 with the portable power tool 100.

Preferably, the mobile computer 1740 has a display 1710, which is preferably configured in the manner of a touchscreen. The display 1710 preferably has, for inputting at least one operating mode of the portable power tool 100, at least one, in the illustration three control elements 1711, 1712, 1713. In the illustration in FIG. 17, the control elements 1711-1713 are formed on the display 1710 as control fields, but could also be configured as switches and/or buttons.

If the user guidance unit 115 has both the control unit 115 and the mobile computer 1740, the above-described control signal is preferably configured to generate on the display 1710 an indication for requesting the initiation of a shifting operation for shifting the shifting unit 205 between the different shift positions S, D, H. In this case, instructions are preferably displayed by the display 1710, for example an instruction as to which shift position S, D, H, or which operating mode is intended to be set for a given operation, which a user of the portable power tool 100 can then set for example via the control elements 116, 117. In this case, the control elements 116, 117 or the control elements (1835-1837 in FIG. 18) on the portable power tool 100 can be provided with illumination means (1831-1833 in FIG. 18), and in this case, the control signal is configured to activate in each case a corresponding illumination means (1831-1833 in FIG. 18).

Furthermore, the mobile computer 1740 can also be integrated at least partially into the portable power tool 100 and setting of the operating mode is preferably carried out in each case automatically, preferably via the shifting unit 205. It should be noted that the exemplary realizations, described in FIG. 17, of the user guidance unit 115 are able to be combined with one another as desired and also, for example, the communication interface 1050 can take on the functionality of the user guidance unit 115.

Figure 18:
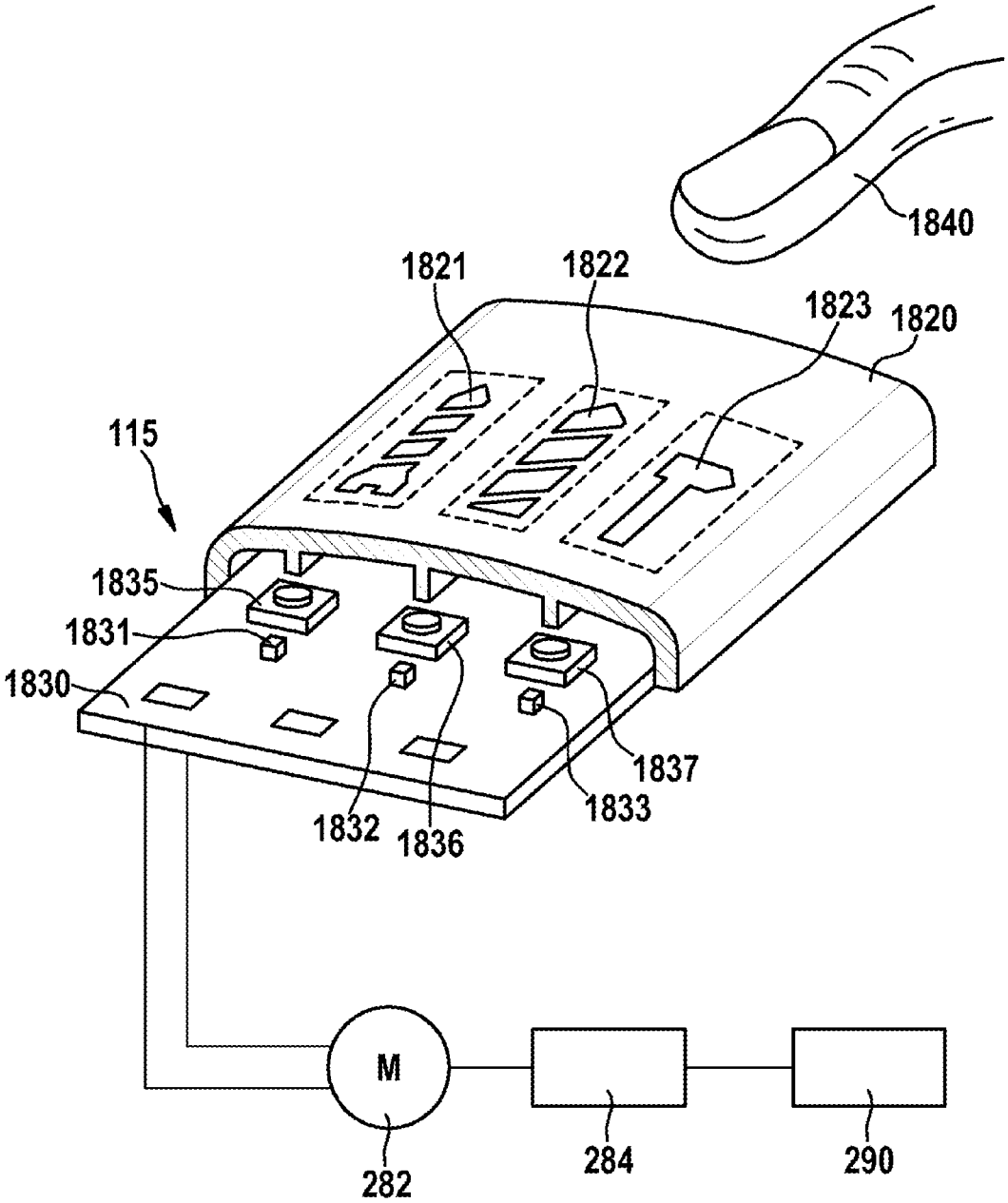
FIG. 18 shows a perspective view of the control unit from FIG. 17.

FIG. 18 shows the user guidance unit 115 from FIG. 1, which is configured preferably in the manner of a control unit 1820 for manually setting a shift position S, D, H or an operating mode. Preferably, the control unit 1820 is provided with at least one, in the illustration three control elements 1821, 1822, 1823 for setting a shift position S, D, H. In the illustration, the control element 1821 is intended to set the screwing mode, the control element 1822 is intended to set the drilling mode, and the control element 1823 is intended to set the percussive mode, wherein the control elements 1821-1823 have for example symbols corresponding to the operating modes. Preferably, the control elements 1821-1823 are arranged on a circuit board 1830. The control unit 1820 is in this case preferably integrated at least partially into the portable power tool 100.

According to one embodiment, the circuit board 1830 preferably has at least one, and in the illustration three shifting elements 1835, 1836, 1837. In order to display a respectively set shift position S, D, H, preferably three display elements 1831, 1832, 1833 are provided. These are configured preferably as illumination elements. In this case, in each case one shifting element 1835-1837 with an illumination element 1831-1833 is assigned to a control element 1821-1823. In the illustration, the shifting element 1835 and the illumination element 1831 are assigned to the control element 1821, the shifting element 1836 and the illumination element 1832 are assigned to the control element 1822, and the shifting element 1837 and the illumination element 1833 are assigned to the control element 1823.

Preferably, the illumination means 1831, 1832, 1833 are able to be activated at least to display the request for initiating a shifting operation for shifting the gearbox 220 between the different gear ratios or to activate the hammer percussion mechanism 260. Preferably, the shifting elements 1835-1837 are configured as switches or buttons and/or the illumination elements 1831-1833 are configured in the manner of LEDs. Alternatively, the control unit 1820 can also be configured in the manner of a display, preferably with a touchscreen, and/or of a mobile computer, wherein a symbol to be actuated in each case can light up and/or flash in each case on the display. The control unit 1820 is connected to the transmission unit 290 for setting an operating mode selected by a user 1840, preferably via the actuating unit 280 or the servomotor 282 and the servomotor gearbox 284.

Figure 19:
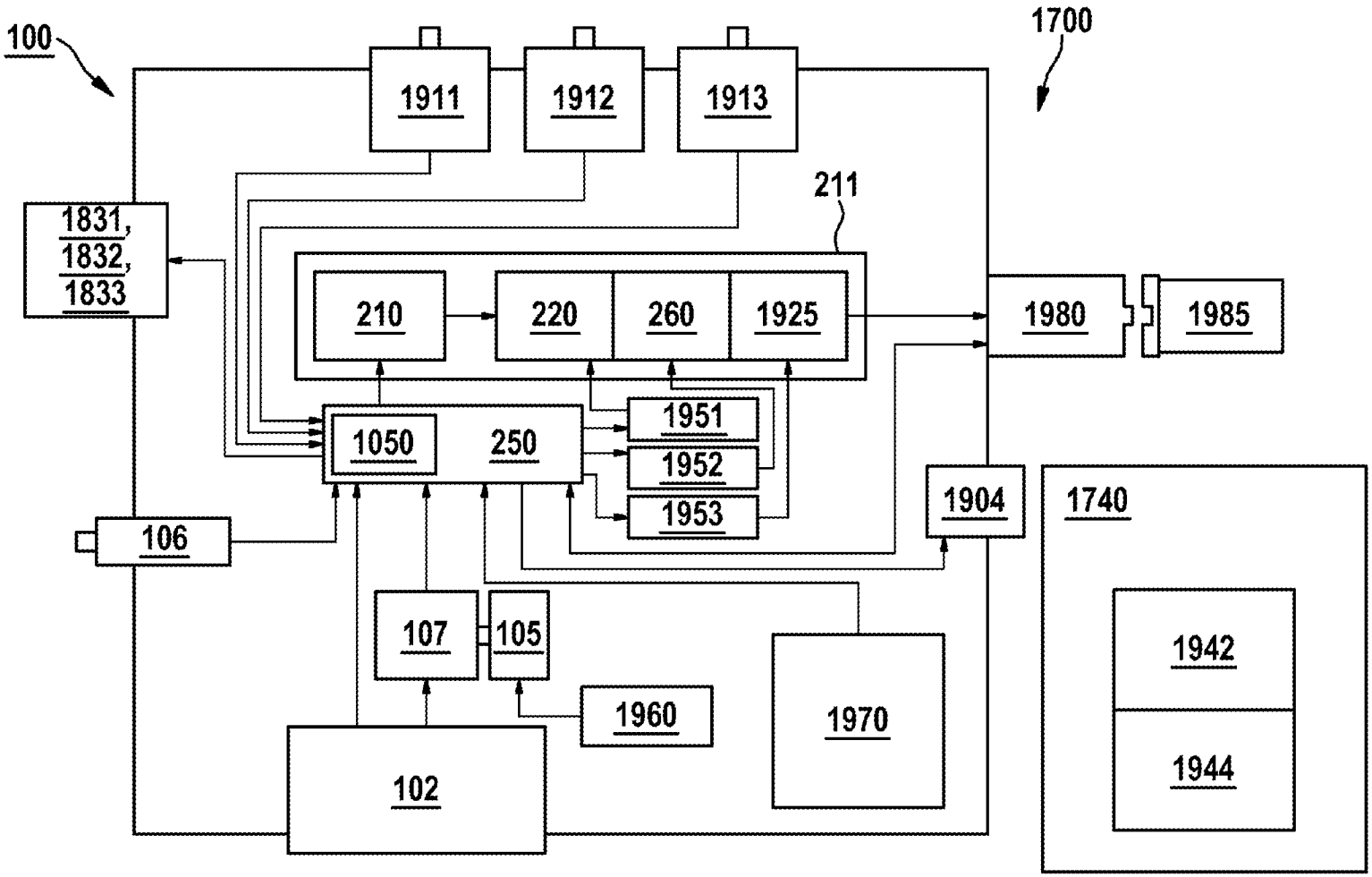
FIG. 19 shows a schematic diagram of the portable power tool from FIG. 1.

FIG. 19 shows the tool system 1700 from FIG. 17 with the portable power tool 100 and the mobile computer 1740 from FIG. 17. In this case, FIG. 19 illustrates the portable power tool 100 with its drive unit 211 from FIG. 2, which has the drive motor 210, the gearbox 220, the hammer percussion mechanism 260, and a torque limiting element 1925 for setting a maximum transmissible torque. In this case, the torque limiting element 1925 can be configured in the manner of a mechanical slipping clutch or of an electrical torque limiter.

In this case, the electronics 250 control at least one actuator 1951, 1952, 1953. In the illustration, three actuators 1951, 1952, 1953 are illustrated in FIG. 19, wherein the actuator 1951 is configured for example for gear shifting of the gearbox 220, the actuator 1952 is configured to activate/deactivate the hammer percussion mechanism 260, and the actuator 1953 is configured to set a torque by means of the torque limiting element 1925. Preferably, upon activation of an actuator 1951-1953, the electronics 250 send an activation signal to an associated illumination element 1831-1833. Alternatively or additionally, the activation signal can also be in the form of an acoustic signal.

According to one embodiment, for communication with the communication interface 1050 of the portable power tool 100, the mobile computer 1740 has an interactive program 1942, 1944, in particular a smartphone app. In this case, preferably a first program 1942 is configured to set applications, for example for screwing a screw into softwood. In this case, the program 1942 preferably determines operating parameters, for example a rotational speed, a direction of rotation, a torque, a gear ratio and/or a percussive-operation requirement, for each application, and sends these to the communication interface 1050 of the portable power tool 100.

Preferably, the communication interface 1050 is in this case configured to transmit a control signal to the actuators 1951, 1952, 1953 of the portable power tool 100, wherein at least one actuator 1951, 1952, 1953 is configured, upon activation by the communication interface 1050, to activate the hammer percussion mechanism 260 and/or to shift the gearbox 220 between the different gear ratios. Preferably, the communication interface 1050 in this case transmits the control signal to the electronics 250, which activate and/or control the respective actuators 1951-1953.

Alternatively or additionally, a second program 1944 is provided, which is configured to set at least one particular operating parameter, for example a rotational speed, a direction of rotation, a torque, a gear ratio and/or a percussive-operation requirement. In this case, a user of the portable power tool 100 enters desired operating parameters directly via the program 1944. These are then transferred to the communication interface 1050 of the portable power tool 100, wherein the communication interface 1050, as described above, sends a corresponding control signal.

Alternatively or additionally, the portable power tool 100 can have at least one signal generator 1911, 1912, 1913 for manually setting a shift position S, D, H, or an operating mode, or for manually setting operating parameters. In the illustration, three signal transmitters 1911, 1912, 1913 are shown in FIG. 19. In this case, a first signal transmitter 1911 is configured for example for gear shifting, a second signal transmitter 1912 is configured to activate and/or deactivate the hammer percussion mechanism 260, and a third signal transmitter 1913 is configured for torque setting. The respective signal transmitter 1911-1913 is preferably configured to send a control signal to the electronics 250 in an application-specific and input-dependent manner, such that the electronics 250 can activate and/or control the respective actuators 1951-1953. Preferably, the signal transmitters 1911-1913 are configured in this case as electrical signal transmitters, but can also be configured as any other desired signal transmitter, for example as a mechanically displaceable lever arm.

Furthermore, the user guidance unit 115 can be assigned a display and/or a mobile computer 1740, which, as described above, displays shifting instructions for the application-specific shifting of the gearbox 220 and/or for activating/deactivating the hammer percussion mechanism 260. In this case, the shifting instructions or activation/deactivation can be visualized as step-by-step instructions on the display and/or the mobile computer 1740.

In this case, in order to initiate a shifting operation for shifting the gearbox 220 between the two different gear ratios and/or to initiate activation/deactivation of the hammer percussion mechanism 260, the at least one control element 116, 117 preferably has a sensor 1970 which is configured to send an actuating signal to the communication interface 1050 and/or the mobile computer 1740 upon actuation of the at least one control element 116, 117, such that a respectively next step in corresponding shifting instructions can be displayed.

Moreover, the sensor 1970 can also be configured as an internal and/or external sensor for monitoring and/or optimizing the portable power tool 100, and preferably as a temperature sensor, acceleration sensor, position sensor etc. In this case, software can be provided which is configured to check and optionally adapt the settings of the electronics 250 or of the portable power tool 100, for example outputting a warning signal and/or carrying out an automatic gearshift in the case of the drive motor 210 becoming hot on account of a too high applied torque.

Preferably, an adapter interface 1980 for connecting to at least one adapter 1985 is provided. In this case, the adapter interface 1980 can be configured in the manner of a mechanical interface, an electrical interface and/or a data interface, wherein the adapter 1985 is configured to transmit information and/or control signals, for example a torque, a rotational speed, a voltage, a current and/or further data, to the portable power tool 100. Preferably, the adapter 1985 has a transmission unit in the case of an adapter interface 1980 configured as a data interface. Preferably, the adapter 1985 can be configured for example as a rangefinder and pass determined parameters to the portable power tool 100 via the adapter interface 1980. In this case, the adapter can be used with and/or without a drive unit 211. Preferably, the adapter 1985 is able to be activated via the mobile computer 1740, wherein the latter or the display can visualize activation of the adapter 1985.

Furthermore, the electronics 250 preferably control the drive motor 210 and/or work-area illumination 1904. In this case, the drive motor 210 is controlled preferably in dependence on a direction-of-rotation signal transmitted by the direction-of-rotation switch 106. Preferably, the hand switch 105 has a lock 1960, which is configured preferably as a mechanical and/or electric lock. Furthermore, the on/off switch 107 and/or the electronics 250 are supplied with current by the rechargeable battery pack 102.

Figure 20:
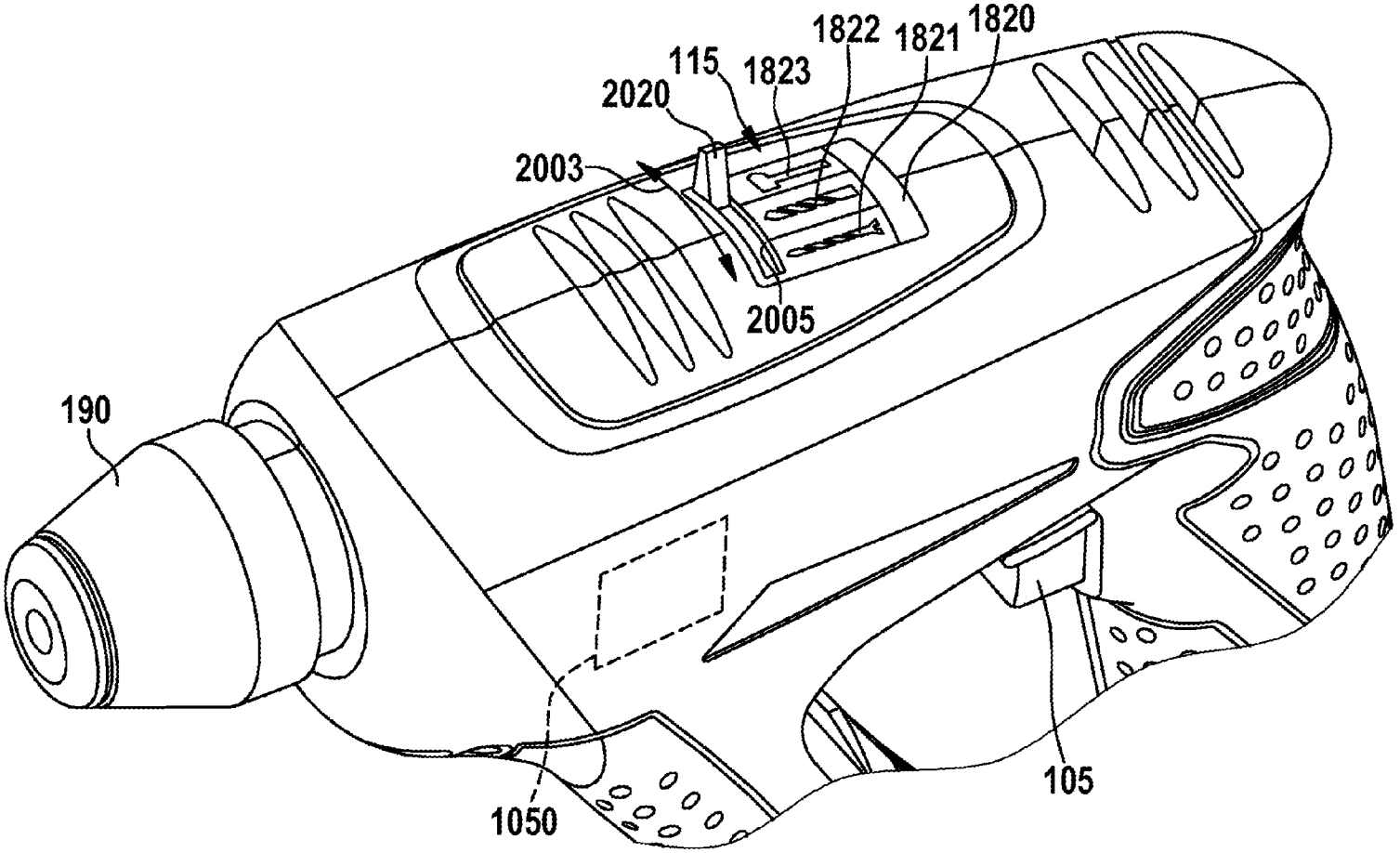
FIG. 20 shows a perspective partial view of the portable power tool from FIG. 1 with a control unit according to a second embodiment.

FIG. 20 shows the control unit 1820 from FIG. 18, which, according to one embodiment, has a setting element 2020 for manually setting the respective operating mode. In this case, the setting element 2020 is preferably formed in one piece with the shifting unit 205 and projects preferably through a cutout 2005 in the control unit 1820. As a result of the setting element 2020 being displaced in the direction of a double arrow 2003, the shifting unit 205 is displaced, with the result that the respective operating mode can be set. Analogously to FIG. 18, the control elements 1821-1823 have symbols corresponding to the respective operating modes.

The invention claimed is:

1. A portable power tool comprising:

a drive unit including at least one shiftable gearbox shiftable between two gears, each of the two gears providing a gear ratio different from a gear ratio of the other of the two gears, the drive unit operably coupled to a percussion mechanism configured to be activated in order to carry out a percussive operation;

a shifting unit configured to shift the at least one shiftable gearbox between the two gears; and a communication interface configured to communicate with a user guidance unit that is actuable by a user, and is further configured to send a first control signal to the user guidance unit enabling a generation of a request initiating an application-specific shifting of the at least one shiftable gearbox between the two gears upon activation by the user, and receive, from the user guidance unit, the shifting instructions to initiate the application-specific shifting of the at least one shiftable gearbox between the two gears, wherein, for communication with the communication interface, the user guidance unit has an interactive program, the user guidance unit has at least one control element configured to initiate the application-specific shifting operation for shifting the at least one shiftable gearbox between the two gears and for activating/deactivating the percussion mechanism, and the communication interface is further configured to send the first control signal to the at least one control element in order to allow a generation of another request for initiation of activation/deactivation of the percussion mechanism by the at least one control element.

2. The portable power tool as claimed in claim 1, wherein the user guidance unit is integrated at least partially into the portable power tool and/or is configured at least partially as an external, separate component.

3. The portable power tool as claimed in claim 1, wherein the user guidance unit has a mobile computer.

4. The portable power tool as claimed in claim 1, wherein the at least one control element includes an illumination device and the first control signal is configured to activate the illumination device in order to visualize the request for the initiation of the application-specific shifting operation for shifting the at least one shiftable gearbox between the two gears and for the initiation of the activation/deactivation of the percussion mechanism.

5. The portable power tool as claimed in claim 1, wherein the at least one control element is configured as a switch or button.

6. The portable power tool as claimed in claim 1, wherein the at least one control element has a display and the first control signal is configured to generate on the display an indication for visualizing the request for the initiation of the application-specific shifting operation for shifting the at least one shiftable gearbox between the two gears and for the initiation of the activation/deactivation of the percussion mechanism.

7. The portable power tool as claimed in claim 6, wherein the display includes a touchscreen.

8. The portable power tool as claimed in claim 1, wherein:

the at least one control element is actuable to initiate the application-specific shifting operation for shifting the at least one shiftable gearbox between the two gears and to initiate the activation/deactivation of the percussion mechanism, and the at least one control element has a sensor configured to transmit an actuation signal to the communication interface upon actuation of the at least one control element.

9. The portable power tool as claimed in claim 1, wherein the shifting unit has at least one servomotor configured, upon activation, to shift the at least one shiftable gearbox between the two gears and, upon activation, to activate/deactivate the percussion mechanism.

10. The portable power tool as claimed in claim 9, wherein the at least one servomotor is configured to be activated by actuation of the at least one control element.

11. The portable power tool as claimed in claim 9, wherein the communication interface is configured to transmit a second control signal to the at least one servomotor in order to activate the at least one servomotor.

12. The portable power tool as claimed in claim 1, wherein:

the communication interface is configured to transmit a second control signal to actuators of the portable power tool, and at least one actuator is configured, upon activation by the communication interface, to shift the at least one shiftable gearbox between the two gears and to activate the percussion mechanism.

13. The portable power tool as claimed in claim 1, wherein the communication interface is configured in the manner of a wireless transmission module.

14. The portable power tool as claimed in claim 1, wherein:

the at least one control element includes a plurality of control elements; and the first control signal is configured to illuminate only a selected one of the plurality of control elements.

15. The portable power tool of claim 14, wherein the selected one of the plurality of control elements is selected based upon a specific application.

* * * * *